US010724766B2

(12) United States Patent
Suzuki et al.

(10) Patent No.: US 10,724,766 B2
(45) Date of Patent: Jul. 28, 2020

(54) REFRIGERATION CYCLE APPARATUS

(71) Applicant: Mitsubishi Electric Corporation, Tokyo (JP)

(72) Inventors: Yasuhiro Suzuki, Tokyo (JP); Masahiko Takagi, Tokyo (JP); Kenyu Tanaka, Tokyo (JP); Kazuki Watanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 162 days.

(21) Appl. No.: 15/768,122

(22) PCT Filed: Dec. 21, 2015

(86) PCT No.: PCT/JP2015/085620
§ 371 (c)(1),
(2) Date: Apr. 13, 2018

(87) PCT Pub. No.: WO2017/109824
PCT Pub. Date: Jun. 29, 2017

(65) Prior Publication Data

US 2018/0299169 A1 Oct. 18, 2018

(51) Int. Cl.
*F24F 1/0029* (2019.01)
*F24F 1/005* (2019.01)
(Continued)

(52) U.S. Cl.
CPC ..... *F25B 1/005* (2013.01); *F24F 1/005* (2019.02); *F24F 1/0029* (2013.01); *F24F 11/36* (2018.01);
(Continued)

(58) Field of Classification Search
CPC ..... F24F 1/0029; F24F 1/005; F24F 11/36; F24F 11/84; F25B 1/005; F25B 2500/22;
(Continued)

(56) References Cited

U.S. PATENT DOCUMENTS

| | | | |
|---|---|---|---|
| 4,829,777 | A | 5/1989 | Matsuoka et al. |
| 2002/0178738 | A1 | 12/2002 | Taira et al. |
| 2016/0245566 | A1 | 8/2016 | Hiraki et al. |

FOREIGN PATENT DOCUMENTS

| | | | |
|---|---|---|---|
| JP | S63-238364 | A | 10/1988 |
| JP | H05-157414 | A | 6/1993 |
| JP | H08-200904 | A | 8/1996 |
| JP | H08-327195 | A | 12/1996 |

(Continued)

OTHER PUBLICATIONS

Office action dated May 7, 2019 issued in corresponding JP patent application No. 2017-557527 (and English translation).

(Continued)

*Primary Examiner* — Edward F Landrum
*Assistant Examiner* — Chang H Park
(74) *Attorney, Agent, or Firm* — Posz Law Group, PLC

(57) ABSTRACT

A refrigeration cycle apparatus includes a refrigerant circuit through which refrigerant is circulated, a heat exchanger unit that accommodates a heat exchanger of the refrigerant circuit and a fan, a temperature sensor disposed in an area of the refrigerant circuit adjacent to a brazed connection or in an area of the refrigerant circuit adjacent to a joint between refrigerant pipes, and a controller configured to determine the presence of refrigerant leakage based on a temperature detected by the temperature sensor. The temperature sensor is covered by a heat insulation material together with the brazed connection or the joint. The controller activates the fan upon determining that refrigerant leakage is present, and is triggered to deactivate the fan in response to the time variation of the temperature detected by the temperature sensor becoming positive.

5 Claims, 14 Drawing Sheets

(51) Int. Cl.

| | |
|---|---|
| ***F24F 11/36*** | (2018.01) |
| ***F24F 11/84*** | (2018.01) |
| ***F25B 1/00*** | (2006.01) |
| ***F25B 49/00*** | (2006.01) |
| ***F25B 49/02*** | (2006.01) |

(52) U.S. Cl.
CPC ..... *F24F 11/84* (2018.01); *F25B 49/005* (2013.01); *F25B 49/02* (2013.01); *F25B 2500/221* (2013.01); *F25B 2500/222* (2013.01); *F25B 2600/11* (2013.01); *F25B 2600/21* (2013.01)

(58) Field of Classification Search
CPC ..... F25B 2500/221; F25B 2500/222; F25B 2600/11; F25B 2600/111; F25B 2600/112; F25B 2600/21; F25B 2700/00; F25B 2700/21; F25B 49/005; F25B 49/02
USPC ..... 300/539.27, 584, 588, 589
See application file for complete search history.

(56) References Cited

FOREIGN PATENT DOCUMENTS

| | | | | | |
|---|---|---|---|---|---|
| JP | H11-173713 | A | | 7/1999 | |
| JP | 2000-081258 | A | | 3/2000 | |
| JP | 3610812 | B2 | * | 1/2005 | |
| JP | 3610812 | B2 | | 1/2005 | |
| JP | 2010-101515 | A | | 5/2010 | |
| JP | 4599699 | B2 | * | 12/2010 | ..... F24F 11/36 |
| JP | 4599699 | B2 | | 12/2010 | |
| JP | 2014-081160 | A | | 5/2014 | |
| JP | 2015-094515 | A | | 5/2015 | |

OTHER PUBLICATIONS

Office Action dated Nov. 1, 2019 issued in corresponding CN patent application No. 201580085322.3 (and English translation).
International Search Report of the International Searching Authority dated Mar. 22, 2016 for the corresponding international application No. PCT/JP2015/085620 (and English translation).

* cited by examiner

REFRIGERATION CYCLE APPARATUS

CROSS REFERENCE TO RELATED APPLICATION

This application is a U.S. national stage application of PCT/JP2015/085620 filed on Dec. 21, 2015, the contents of which are incorporated herein by reference.

TECHNICAL FIELD

The present invention relates to a refrigeration cycle apparatus.

BACKGROUND ART

Patent Literature 1 describes an air-conditioning apparatus. The air-conditioning apparatus includes a gas sensor disposed on the outer surface of an indoor unit to detect refrigerant, and a controller that, when refrigerant is detected by the gas sensor, controls an indoor fan to rotate. The air-conditioning apparatus is configured such that, if refrigerant leaks out into the indoor space from an extension pipe leading to the indoor unit, or if refrigerant that has leaked out inside the indoor unit escapes to the outside of the indoor unit through a gap in the housing of the indoor unit, the leaking refrigerant can be detected by the gas sensor. Further, the indoor fan is rotated upon detection of refrigerant leakage to suck in indoor air through an air inlet provided in the housing of the indoor unit and blow air indoors from an air outlet. This allows the leaking refrigerant to be dispersed.

Patent Literature 2 describes a refrigeration apparatus. The refrigeration apparatus includes a temperature sensor that detects the temperature of liquid refrigerant, and a refrigerant leak determination unit that, when a refrigerant temperature detected by the temperature sensor drops at a rate exceeding a predetermined rate while the compressor is in deactivated condition, determines that refrigerant is leaking. The temperature sensor is disposed in an area of the refrigerant circuit where liquid refrigerant can accumulate, specifically, in a lower part of the header of the indoor heat exchanger. Patent Literature 2 describes that rapid leakage of refrigerant can be detected by means of detecting a rapid decrease in the temperature of liquid refrigerant.

Patent Literature 3 describes a refrigeration apparatus. The refrigeration apparatus includes a refrigerant detection unit that detects refrigerant leakage, and a controller that, when a refrigerant leak is detected by the refrigerant detection unit, activates a fan used for a condenser or evaporator. When refrigerant leaks out in the refrigeration apparatus, the refrigerant is dispersed or exhausted by means of the fan driven by a controller. This prevents refrigerant concentration from increasing at a given location. The controller is configured such that, after the fan is driven upon detection of refrigerant leakage, the controller deactivates the fan if refrigerant is dispersed or exhausted and thus ceases to be detected by the refrigerant detection unit. Patent Literature 3 also describes that once refrigerant leakage is detected, the controller may, irrespective of the subsequent detection signal, drive the fan for a predetermined time by use of a timer, or drive the fan until a switch to stop passage of electric current is turned off by the operating person.

CITATION LIST

Patent Literature

Patent Literature 1: Japanese Patent No. 4599699
Patent Literature 2: Japanese Patent No. 3610812

Patent Literature 3: Japanese Unexamined Patent Application Publication No. 08-327195

SUMMARY OF INVENTION

Technical Problem

The air-conditioning apparatus described in Patent Literature 1 uses a gas sensor as a refrigerant detection unit. The detection characteristics of a gas sensor tend to change over time, which means that the air-conditioning apparatus described in Patent Literature 1 may fail to provide reliable detection of refrigerant leakage over an extended period of time.

The refrigeration apparatus described in Patent Literature 2 uses, as a refrigerant detection unit, a temperature sensor that has long-term reliability instead of a gas sensor. A problem with this approach is that it is not always possible to control how refrigerant is distributed within a refrigerant circuit at the time when the compressor is deactivated. Consequently, there are variations in the amount of liquid refrigerant that accumulates at the location where the temperature sensor is disposed. This introduces variations also in the degree to which refrigerant temperature drops due to the heat of vaporization when refrigerant leaks. Moreover, refrigerant leakage does not necessarily occur at a location where liquid refrigerant accumulates. If refrigerant leaks at a location other than a location where liquid refrigerant accumulates, it is mainly gas refrigerant that leaks out first. This means that it takes a while until refrigerant temperature drops as a result of the liquid refrigerant vaporizing at the location where the liquid refrigerant accumulates. Therefore, the refrigeration apparatus described in Patent Literature 2 may fail to provide responsive detection of refrigerant leakage.

The refrigeration apparatus described in Patent Literature 3 deactivates the fan when the refrigerant detection unit no longer detects refrigerant and thus the detection signal ceases, that is, when the concentration of leaking refrigerant becomes zero. This means that the fan continues to be driven unless the indoor refrigerant concentration becomes zero, which may cause users to incur unnecessary electricity bills. In the case of the configuration in which the fan is driven for a predetermined time by use of a timer or the fan is driven until a switch to stop passage of electric current is turned off by the operating person, it is possible that refrigerant leakage is continuing even after the fan is deactivated. This can lead to the occurrence of localized increases in indoor refrigerant concentration after the fan is deactivated.

The present invention has been made to address at least one of the problems mentioned above. Accordingly, it is a first object of the present invention to provide a refrigeration cycle apparatus that enables reliable and responsive detection of refrigerant leakage over an extended period of time.

It is a second object of the present invention to provide a refrigeration cycle apparatus that, even in the event of refrigerant leakage, helps minimize localized increases in refrigerant concentration and also prevent unnecessary energy consumption.

Solution to Problem

A refrigeration cycle apparatus according to an embodiment of the present invention includes a refrigerant circuit through which refrigerant is circulated; a heat exchanger unit accommodating a heat exchanger of the refrigerant circuit, and a fan; a temperature sensor disposed in an area of the refrigerant circuit adjacent to a brazed connection, or in an area of the refrigerant circuit adjacent to a joint between refrigerant pipes; and a controller configured to determine presence of refrigerant leakage based on a temperature detected by the temperature sensor, the temperature sensor being covered by a heat insulation material together with the brazed connection or the joint, the controller being configured to activate the fan upon determining that refrigerant leakage is present, and be triggered to deactivate the fan in response to a time variation of the temperature detected by the temperature sensor becoming positive.

Advantageous Effects of Invention

An embodiment of the present invention provides reliable and responsive detection of refrigerant leakage over an extended period of time.

An embodiment of the present invention helps minimize localized increases in refrigerant concentration and also prevent unnecessary energy consumption, even in the event of refrigerant leakage.

DESCRIPTION OF EMBODIMENTS

Embodiment 1

Figure 1:
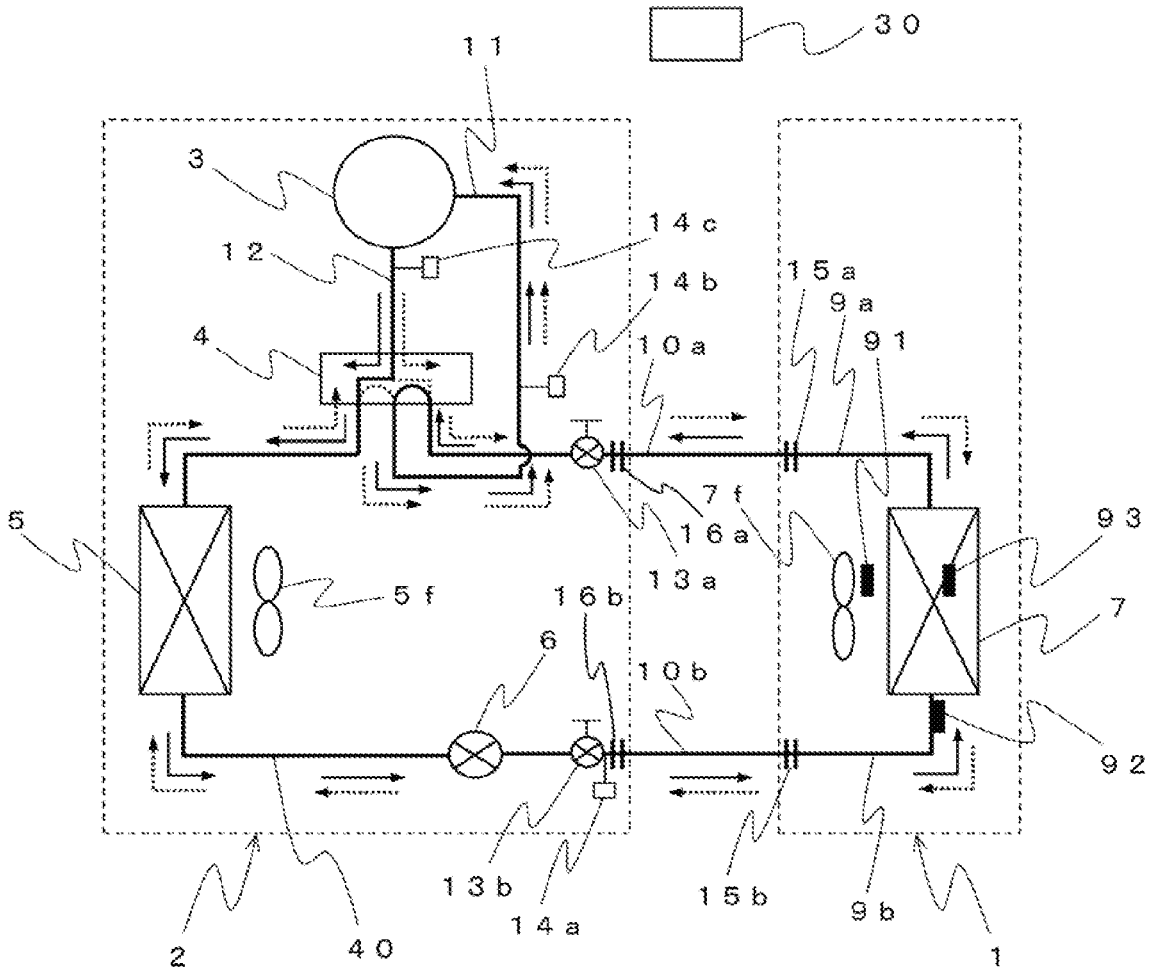
FIG. 1 is a refrigerant circuit diagram illustrating the general configuration of an air-conditioning apparatus according to Embodiment 1 of the present invention.

A refrigeration cycle apparatus according to Embodiment 1 of the present invention will be described below. In Embodiment 1, an air-conditioning apparatus will be described as an example of a refrigeration cycle apparatus. FIG. 1 is a refrigerant circuit diagram illustrating the general configuration of an air-conditioning apparatus according to Embodiment 1. In the drawings including FIG. 1, features such as the relative sizes of components and their shapes may differ from the actuality in some cases.

As illustrated in FIG. 1, the air-conditioning apparatus has a refrigerant circuit 40 through which refrigerant is circulated. The refrigerant circuit 40 includes the following components sequentially connected in a loop by a refrigerant pipe: a compressor 3, a refrigerant flow switching device 4, a heat source-side heat exchanger 5 (for example, an outdoor heat exchanger), a pressure reducing device 6, and a load-side heat exchanger 7 (for example, an indoor heat exchanger). The air-conditioning apparatus has, as a heat source unit, an outdoor unit 2 (an example of a heat exchanger unit) that is placed outdoors, for example. Further, the air-conditioning apparatus has, as a load unit, an indoor unit 1 (an example of a heat exchanger unit) that is placed indoors, for example. The indoor unit 1 and the outdoor unit 2 are connected to each other by extension pipes 10*a* and 10*b* each constituting a part of the refrigerant pipe.

Examples of refrigerant circulated in the refrigerant circuit 40 include a mildly flammable refrigerant such as HFO-1234yf or HFO-1234ze, and a highly flammable refrigerant such as R290 or R1270. Each of these refrigerants may be used as a single-component refrigerant, or may be used as a mixture of two or more types of refrigerant. Hereinafter, refrigerants with levels of flammability equal to or higher than mild flammability (for example, 2L or higher according to the ASHRAE-34 classification) will be sometimes referred to as "flammable refrigerants". A non-flammable refrigerant having non-flammability (for example, "1" according to the ASHRAE-34 classification), such as R22 or R410A, may be also used as the refrigerant to be circulated in the refrigerant circuit 40. These refrigerants have, for example, densities greater than the density of air under atmospheric pressure.

The compressor 3 is a piece of fluid machinery that compresses a low-pressure refrigerant sucked into the compressor 3, and discharges the compressed refrigerant as a high-pressure refrigerant. The refrigerant flow switching device 4 switches the directions of refrigerant flow in the refrigerant circuit 40 between cooling operation and heating operation. The refrigerant flow switching device 4 used is, for example, a four-way valve. The heat source-side heat exchanger 5 acts as a radiator (for example, a condenser) in cooling operation, and acts as an evaporator in heating operation. In the heat source-side heat exchanger 5, heat is exchanged between the refrigerant flowing in the heat source-side heat exchanger 5, and the outdoor air being supplied by an outdoor fan 5*f* described later. The pressure reducing device 6 causes a high-pressure refrigerant to be reduced in pressure and change to a low-pressure refrigerant. The pressure reducing device 6 used is, for example, an electronic expansion valve with an adjustable opening degree. The load-side heat exchanger 7 acts as an evaporator in cooling operation, and acts as a radiator (for example, a condenser) in heating operation. In the load-side heat exchanger 7, heat is exchanged between the refrigerant flowing in the load-side heat exchanger 7, and the air being supplied by an indoor fan 7*f* described later. In this regard, cooling operation refers to an operation in which a low-temperature, low-pressure refrigerant is supplied to the load-side heat exchanger 7, and heating operation refers to an operation in which a high-temperature, high-pressure refrigerant is supplied to the load-side heat exchanger 7.

The outdoor unit 2 accommodates the compressor 3, the refrigerant flow switching device 4, the heat source-side heat exchanger 5, and the pressure reducing device 6. The outdoor unit 2 also accommodates the outdoor fan 5*f* that supplies outdoor air to the heat source-side heat exchanger 5. The outdoor fan 5*f* is placed opposite the heat source-side heat exchanger 5. Rotating the outdoor fan 5*f* creates a flow of air that passes through the heat source-side heat exchanger 5. The outdoor fan 5*f* used is, for example, a propeller fan. The outdoor fan 5*f* is disposed, for example, downstream of the heat source-side heat exchanger 5 with respect to the flow of air created by the outdoor fan 5*f*.

Refrigerant pipes disposed in the outdoor unit 2 include a refrigerant pipe connecting an extension-pipe connection valve 13*a* with the refrigerant flow switching device 4 and serving as a gas-side refrigerant pipe in cooling operation, a suction pipe 11 connected to the suction side of the compressor 3, a discharge pipe 12 connected to the discharge side of the compressor 3, a refrigerant pipe connecting the refrigerant flow switching device 4 with the heat source-side heat exchanger 5, a refrigerant pipe connecting the heat source-side heat exchanger 5 with the pressure reducing device 6, and a refrigerant pipe connecting an extension-pipe connection valve 13*b* with the pressure reducing device 6 and serving as a liquid-side refrigerant pipe in cooling operation. The extension-pipe connection valve 13*a* is implemented by a two-way valve capable of being switched open and close. A fitting 16*a* (for example, a flare fitting) is attached at one end of the extension-pipe connection valve 13*a*. The extension-pipe connection valve 13*b* is implemented by a three-way valve capable of being switched open and close. A service port 14*a*, which is used during vacuuming performed prior to filling the refrigerant circuit 40 with refrigerant, is attached at one end of the extension-pipe connection valve 13*b*. A fitting 16*b* (for example, a flare fitting) is attached at the other end of the extension-pipe connection valve 13*b*.

A high-temperature, high-pressure gas refrigerant compressed by the compressor 3 flows through the discharge pipe 12 in both cooling operation and heating operation. A low-temperature, low-pressure gas refrigerant or two-phase refrigerant that has undergone evaporation flows through the suction pipe 11 in both cooling operation and heating operation. A service port 14*b* with flare fitting, which is located on the low-pressure side, is connected to the suction pipe 11. A service port 14*c* with flare fitting, which is located on the high-pressure side, is connected to the discharge pipe 12. The service ports 14*b* and 14*c* are each used to connect a pressure gauge to measure operating pressure during a test run made at the time of installation or repair of the air-conditioning apparatus.

The indoor unit 1 accommodates the load-side heat exchanger 7. The indoor unit 1 also accommodates the indoor fan 7*f* that supplies air to the load-side heat exchanger 7. Rotating the indoor fan 7*f* creates a flow of air that passes through the load-side heat exchanger 7. Depending on the type of the indoor unit 1, the indoor fan 7*f* used is, for example, a centrifugal fan (for example, a sirocco fan or a turbo fan), a cross-flow fan, a mixed flow fan, or an axial fan (for example, a propeller fan). Although the indoor fan 7*f* in this example is disposed upstream of the load-side heat exchanger 7 with respect to the flow of air created by the indoor fan 7*f*, the indoor fan 7*f* may be disposed downstream of the load-side heat exchanger 7.

Among refrigerant pipes in the indoor unit 1, an indoor pipe 9*a* on the gas side is provided with a fitting 15*a* (for example, a flare fitting), which is located at the connection with the extension pipe 10*a* on the gas side to connect the extension pipe 10*a*. Further, among refrigerant pipes in the indoor unit 1, an indoor pipe 9*b* on the liquid side is provided with a fitting 15*b* (for example, a flare fitting), which is located at the connection with the extension pipe 10*b* on the liquid side to connect the extension pipe 10*b*.

The indoor unit 1 is provided with components such as a suction air temperature sensor 91 that detects the temperature of indoor air sucked in from the indoor space, a heat exchanger liquid pipe temperature sensor 92 that detects the temperature of liquid refrigerant at the location of the load-side heat exchanger 7 that becomes the inlet during cooling operation (the outlet during heating operation), and a heat exchanger two-phase pipe temperature sensor 93 that detects the temperature (evaporating temperature or condensing temperature) of two-phase refrigerant in the load-side heat exchanger 7. Further, the indoor unit 1 is provided with temperature sensors 94*a*, 94*b*, 94*c*, and 94*d* (not illustrated in FIG. 1) described later that are used to detect refrigerant leakage. The temperature sensors 91, 92, 93, 94*a*, 94*b*, 94*c*, and 94*d* each output a detection signal to a controller 30 that controls the indoor unit 1 or the entire air-conditioning apparatus.

The controller 30 has a microcomputer including components such as a CPU, a ROM, a RAM, an I/O port, and a timer. The controller 30 is capable of communicating data with an operating unit 26 (see FIG. 2). The operating unit 26 receives an operation made by the user, and outputs an operational signal based on the operation to the controller 30. The controller 30 in this example controls, based on information such as an operational signal from the operating unit 26 or detection signals from various sensors, the operation of the indoor unit 1 or the entire air-conditioning apparatus, including operation of the indoor fan 7*f*. The controller 30 may be disposed inside the housing of the indoor unit 1, or may be disposed inside the housing of the outdoor unit 2. The controller 30 may include an outdoor-unit controller disposed in the outdoor unit 2, and an indoor-unit controller disposed in the indoor unit 1 and capable of communicating data with the outdoor-unit controller.

Next, operation of the refrigerant circuit 40 of the air-conditioning apparatus will be described. First, cooling operation will be described. In FIG. 1, solid arrows indicate the flow of refrigerant in cooling operation. The refrigerant circuit 40 is configured such that in cooling operation, the flows of refrigerant are switched by the refrigerant flow switching device 4 as indicated by the solid lines to direct a low-temperature, low-pressure refrigerant into the load-side heat exchanger 7.

A high-temperature, high-pressure gas refrigerant discharged from the compressor 3 first flows into the heat source-side heat exchanger 5 via the refrigerant flow switching device 4. In cooling operation, the heat source-side heat exchanger 5 acts as a condenser. That is, in the heat source-side heat exchanger 5, heat is exchanged between the refrigerant flowing in the heat source-side heat exchanger 5, and the outdoor air being supplied by the outdoor fan 5*f*, and the condensation heat of the refrigerant is rejected to the outdoor air. This causes the refrigerant entering the heat source-side heat exchanger 5 to condense into a high-pressure liquid refrigerant. The high-pressure liquid refrigerant flows into the pressure reducing device 6 where the refrigerant is reduced in pressure and changes to a low-pressure, two-phase refrigerant. The low-pressure, two-phase refrigerant flows into the load-side heat exchanger 7 of the indoor unit 1 via the extension pipe 10*b*. In cooling operation, the load-side heat exchanger 7 acts as an evaporator. That is, in the load-side heat exchanger 7, heat is exchanged between the refrigerant flowing in the load-side heat exchanger 7, and the air (for example, indoor air) being supplied by the indoor fan 7*f*, and the evaporation heat of the refrigerant is removed from the air. This causes the refrigerant entering the load-side heat exchanger 7 to evaporate into a low-pressure gas refrigerant or two-phase refrigerant. The air supplied by the indoor fan 7*f* is cooled as the refrigerant removes heat from the air. The low-pressure gas refrigerant or two-phase refrigerant evaporated in the load-side heat exchanger 7 is sucked into the compressor 3 via the extension pipe 10*a* and the refrigerant flow switching device 4. The refrigerant sucked into the compressor 3 is compressed into a high-temperature, high-pressure gas refrigerant. The above cycle is repeated in cooling operation.

Next, heating operation will be described. In FIG. 1, dotted arrows indicate the flow of refrigerant in heating operation. The refrigerant circuit 40 is configured such that in heating operation, the flows of refrigerant are switched by the refrigerant flow switching device 4 as indicated by the dotted lines to direct a high-temperature, high-pressure refrigerant into the load-side heat exchanger 7. In heating operation, the refrigerant flows in a direction opposite to that in cooling operation, with the load-side heat exchanger 7 acting as a condenser. That is, in the load-side heat exchanger 7, heat is exchanged between the refrigerant flowing in the load-side heat exchanger 7, and the air being supplied by the indoor fan 7*f*, and the condensation heat of the refrigerant is rejected to the air. The air supplied by the indoor fan 7*f* is thus heated as the refrigerant rejects heat to the air.

Figure 2:
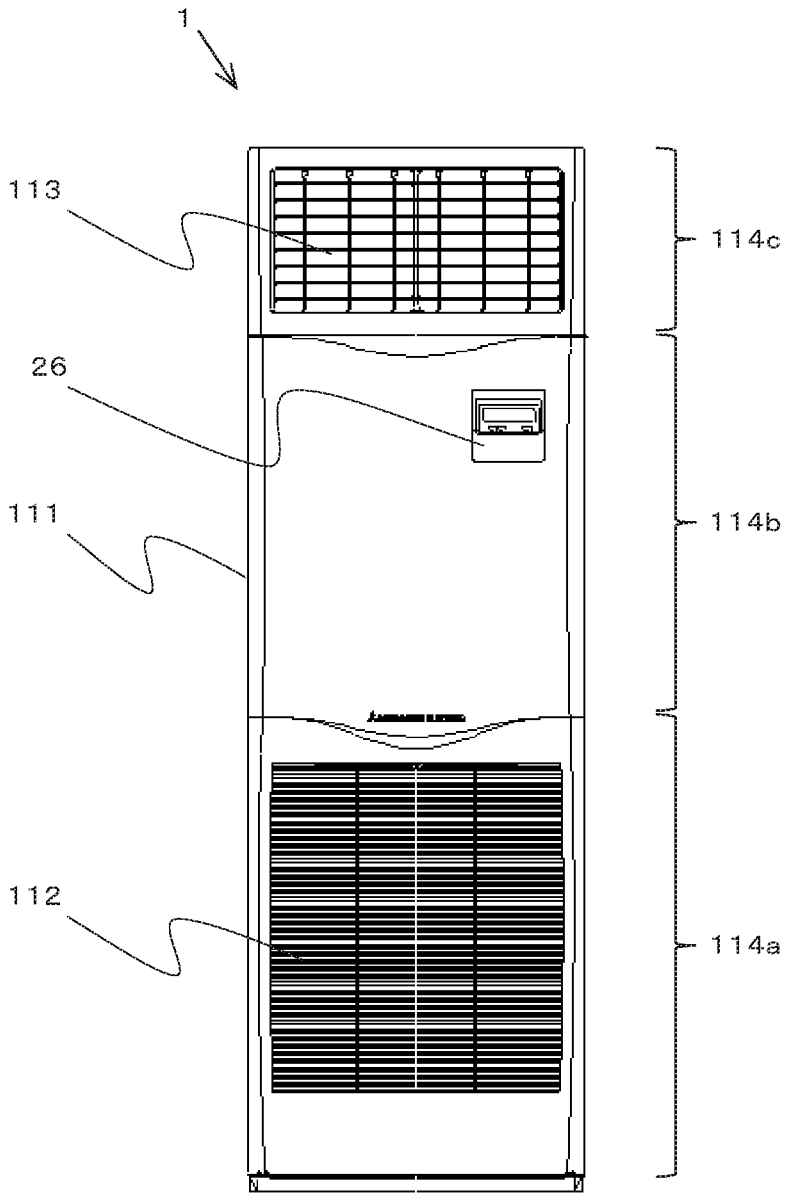
FIG. 2 is a front view of an indoor unit 1 of the air-conditioning apparatus according to Embodiment 1 of the present invention, illustrating the outward appearance of the indoor unit 1.
Figure 3:
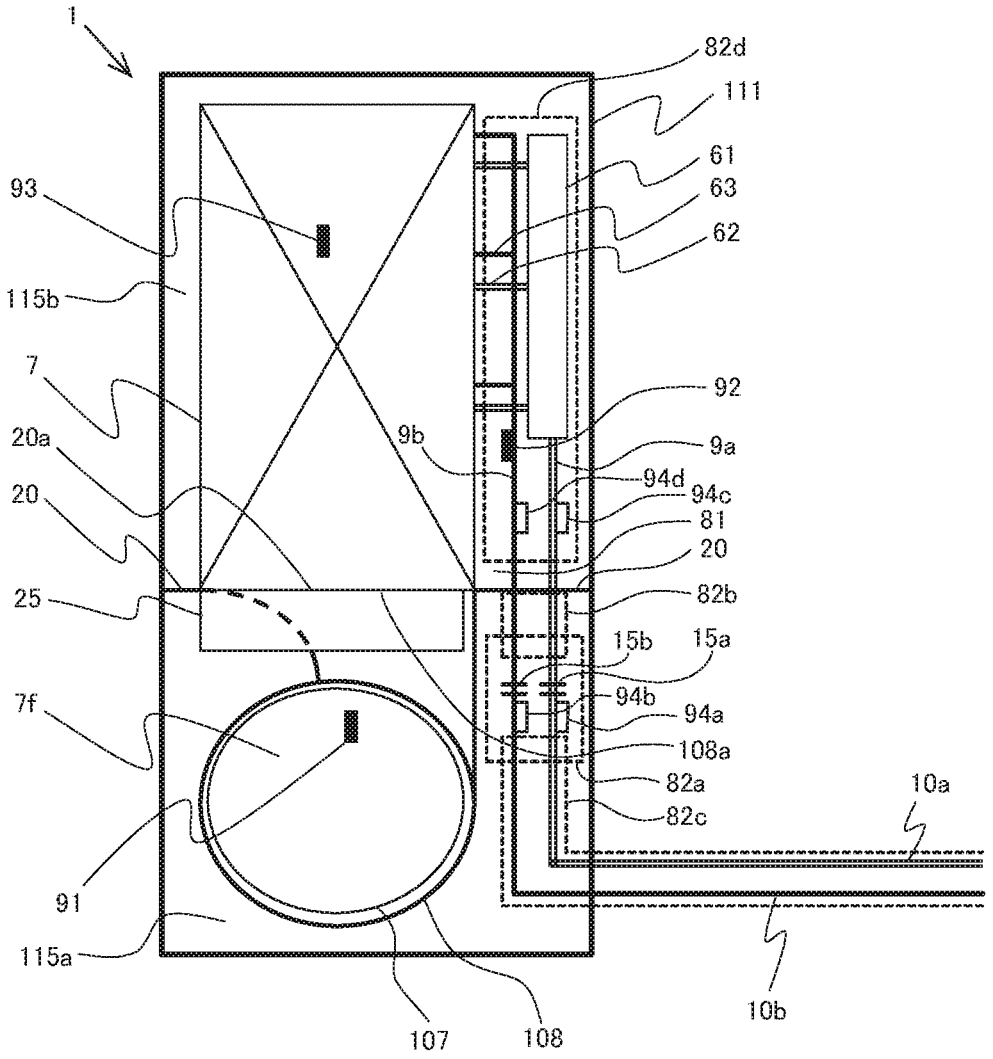
FIG. 3 is a front view of the indoor unit 1 of the air-conditioning apparatus according to Embodiment 1 of the present invention, schematically illustrating the internal structure of the indoor unit 1.
Figure 4:
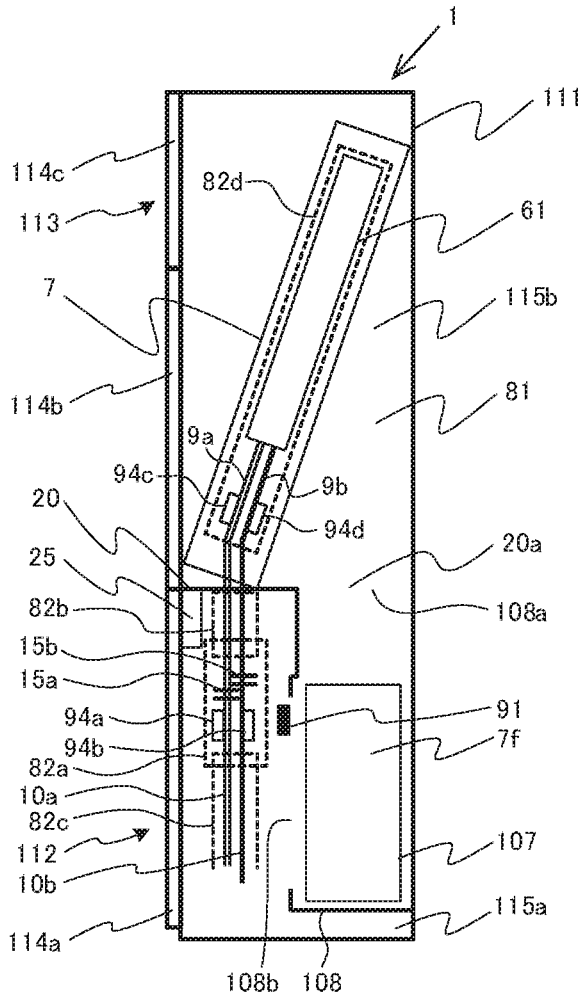
FIG. 4 is a side view of the indoor unit 1 of the air-conditioning apparatus according to Embodiment 1 of the present invention, schematically illustrating the internal structure of the indoor unit 1.

FIG. 2 is a front view of the indoor unit 1 of the air-conditioning apparatus according to Embodiment 1, illustrating the outward appearance of the indoor unit 1. FIG. 3 is a front view of the indoor unit 1, schematically illustrating the internal structure of the indoor unit 1. FIG. 4 is a side view of the indoor unit 1, schematically illustrating the internal structure of the indoor unit 1. The left-hand side in FIG. 4 represents the side toward the front (toward the indoor space) of the indoor unit 1. Embodiment 1 employs, as an example of the indoor unit 1, the indoor unit 1 of a floor-standing type placed on the floor surface of the indoor space that is the air-conditioned space. As a general rule, the relative positions of components (for example, their relative vertical arrangement) in the following description will be based on those when the indoor unit 1 is placed in its ready-to-use position.

As illustrated in FIGS. 2 to 4, the indoor unit 1 includes a housing 111 with a vertically elongated rectangular parallelepiped shape. An air inlet 112 for sucking indoor air is located in a lower part of the front face of the housing 111. The air inlet 112 in this example is located below the vertically central part of the housing 111, near the floor surface. An air outlet 113 for blowing out the air sucked in through the air inlet 112 is located in an upper part of the front face of the housing 111, that is, at a position higher than the air inlet 112 (for example, at a position above the vertically central part of the housing 111). The operating unit 26 is disposed on the front face of the housing 111, at a position above the air inlet 112 and below the air outlet 113. The operating unit 26 is connected to the controller 30 via a communication line. The operating unit 26 and the controller 30 are thus capable of communicating data with each other. The operating unit 26 is operated by the user to perform operations such as starting and ending the operation of the air-conditioning apparatus, switching of operation modes, and setting of a preset temperature and a preset air volume. The operating unit 26 may be provided with a component such as a display or an audio output unit as an informing unit that provides information to the user.

The housing 111 is in the form of a hollow box. The front face of the housing 111 is provided with a front opening. The housing 111 includes a first front panel 114*a*, a second front panel 114*b*, and a third front panel 114*c* that are detachably attached over the front opening. Each of the first front panel 114*a*, the second front panel 114*b*, and the third front panel 114*c* has a substantially rectangular, flat outer shape. The first front panel 114*a* is detachably attached over a lower part of the front opening of the housing 111. The first front panel 114*a* is provided with the air inlet 112. The second front panel 114*b* is disposed above and adjacent to the first front panel 114*a*, and detachably attached over the vertically central part of the front opening of the housing 111. The second front panel 114*b* is provided with the operating unit 26. The third front panel 114*c* is disposed above and adjacent to the second front panel 114*b*, and detachably attached over an upper part of the front opening of the housing 111. The third front panel 114*c* is provided with the air outlet 113.

The internal space of the housing 111 is roughly divided into a lower space 115*a* serving as an air-sending part, and an upper space 115*b* located above the lower space 115*a* and serving as a heat exchange part. The lower space 115*a* and the upper space 115*b* are partitioned off by a partition unit 20. The partition unit 20 has the shape of, for example, a flat plate, and is oriented substantially horizontally. The partition unit 20 is provided with at least an air passage opening 20*a*, which serves as an air passage between the lower space 115*a* and the upper space 115*b*. The lower space 115*a* is exposed to the front side when the first front panel 114*a* is detached from the housing 111. The upper space 115*b* is exposed to the front side when the second front panel 114*b* and the third front panel 114*c* are detached from the housing 111. That is, the partition unit 20 is placed at substantially the same height as the upper end of the first front panel 114*a* or the lower end of the second front panel 114*b*. The partition unit 20 may be formed integrally with a fan casing 108 described later, may be formed integrally with a drain pan described later, or may be formed as a component separate from the fan casing 108 and the drain pan.

The indoor fan 7*f* is disposed in the lower space 115*a* to create, in an air passage 81 within the housing 111, a flow of air that travels toward the air outlet 113 from the air inlet 112. The indoor fan 7*f* in this example is a sirocco fan including a motor (not illustrated), and an impeller 107 connected to the output shaft of the motor and having a plurality of blades arranged circumferentially at equal intervals, for example. The impeller 107 is disposed such that its rotational axis is substantially parallel to the direction of the depth of the housing 111. The motor used for the indoor fan 7*f* is a non-brush type motor (for example, an induction motor or a DC brushless motor). This ensures that sparking does not occur when the indoor fan 7*f* rotates.

The impeller 107 of the indoor fan 7*f* is covered by the fan casing 108 having a spiral shape. The fan casing 108 is formed as a component separate from the housing 111, for example. An air inlet opening 108*b* for sucking the indoor air into the fan casing 108 through the air inlet 112 is located in the vicinity of the center of the spiral of the fan casing 108. The air inlet opening 108*b* is positioned opposite the air inlet 112. Further, an air outlet opening 108*a* for blowing out the air to be sent is located in the direction of the tangent to the spiral of the fan casing 108. The air outlet opening 108*a* is directed upward, and connected to the upper space 115*b* via the air passage opening 20*a* of the partition unit 20. In other words, the air outlet opening 108*a* communicates the upper space 115*b* via the air passage opening 20*a*. The open end of the air outlet opening 108*a* and the open end of the air passage opening 20*a* may be directly connected with each other, or may be indirectly connected with each other via a component such as a duct member.

For example, a microcomputer constituting the controller 30, and an electrical component box 25 for accommodating components such as various electrical components and a board are disposed in the lower space 115*a*.

The upper space 115*b* is located downstream of the lower space 115*a* with respect to the flow of air created by the indoor fan 7*f*. The load-side heat exchanger 7 is disposed in the air passage 81 within the upper space 115*b*. A drain pan (not illustrated) is disposed below the load-side heat exchanger 7 to receive condensed water that has condensed on the surface of the load-side heat exchanger 7. The drain pan may be formed as a part of the partition unit 20, or may be formed as a component separate from the partition unit 20 and disposed over the partition unit 20.

Upon driving the indoor fan 7*f*, indoor air is sucked in through the air inlet 112. The sucked indoor air passes through the load-side heat exchanger 7 and turns into conditioned air, which is blown indoors from the air outlet 113.

Figure 5:
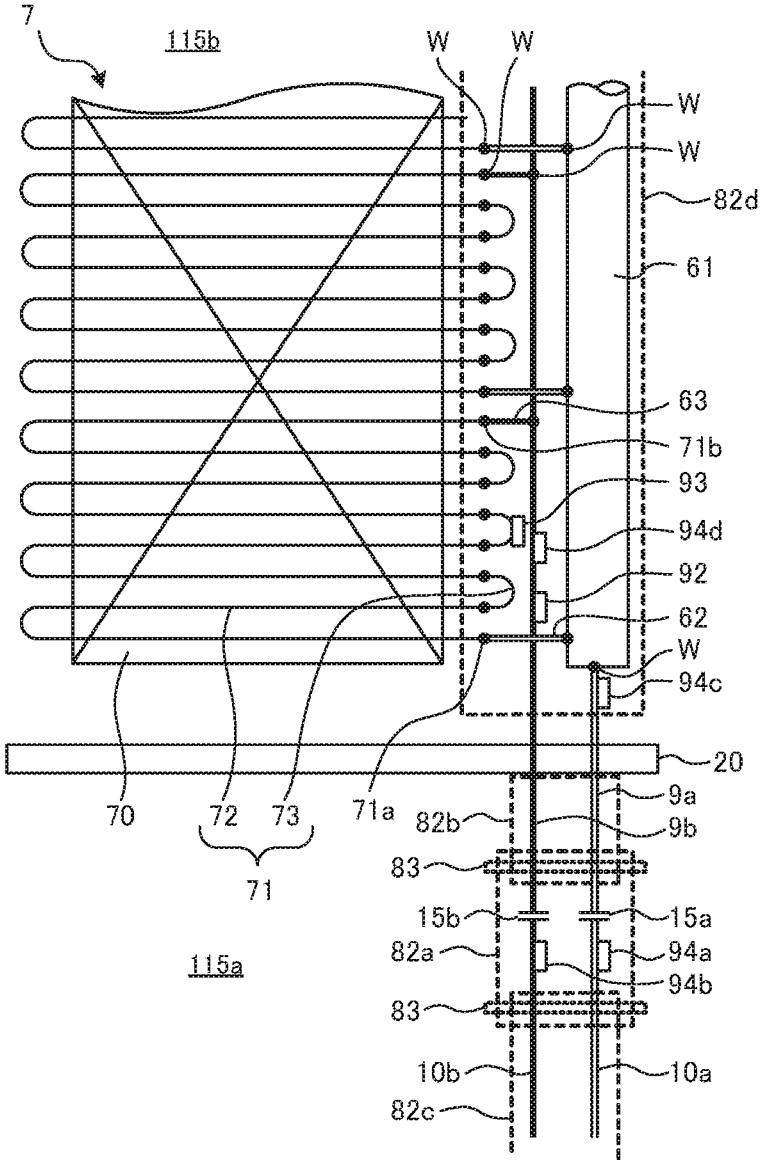
FIG. 5 is a front view of the air-conditioning apparatus according to Embodiment 1 of the present invention, schematically illustrating the configuration of a load-side heat exchanger 7 and the configuration of components in the vicinity of the load-side heat exchanger 7.

FIG. 5 is a front view of the air-conditioning apparatus according to Embodiment 1, schematically illustrating the configuration of the load-side heat exchanger 7 and the configuration of components in the vicinity of the load-side heat exchanger 7. As illustrated in FIG. 5, the load-side heat exchanger 7 in this example is a fin-tube heat exchanger including a plurality of fins 70 arranged in parallel at predetermined intervals, and a plurality of heat transfer tubes 71 penetrating the fins 70 and in which refrigerant is circulated. The heat transfer tubes 71 each include a plurality of hairpin tubes 72 with a long straight tube portion penetrating the fins 70, and a plurality of U-bent tubes 73 that provide communication between adjacent hairpin tubes 72. The hairpin tube 72 and the U-bent tube 73 are joined by a brazed connection W. In FIG. 5, each brazed connection W is indicated by a filled circle. The number of heat transfer tubes 71 to be provided may be one or more. The number of hairpin tubes 72 constituting each single heat transfer tube 71 may be also one or more. The heat exchanger two-phase pipe temperature sensor 93 is provided to the U-bent tube 73 that is located in the middle portion of the refrigerant path of the heat transfer tube 71.

The indoor pipe 9*a* on the gas side is connected with a header main pipe 61 having a cylindrical shape. The header main pipe 61 is connected with a plurality of header branch pipes 62 that branch off from the header main pipe 61. Each of the header branch pipes 62 is connected with one end portion 71*a* of the corresponding heat transfer tube 71. The indoor pipe 9*b* on the liquid side is connected with a plurality of indoor refrigerant branch pipes 63 that branch off from the indoor pipe 9*b*. Each of the indoor refrigerant branch pipes 63 may be connected with the other end portion 71*b* of the corresponding heat transfer tube 71. The heat exchanger liquid pipe temperature sensor 92 is provided to the indoor pipe 9*b*.

A brazed connection W joins the indoor pipe 9*a* with the header main pipe 61, the header main pipe 61 with the header branch pipe 62, the header branch pipe 62 with the heat transfer tube 71, the indoor pipe 9*b* with the indoor refrigerant branch pipe 63, and the indoor refrigerant branch pipe 63 with the heat transfer tube 71.

In Embodiment 1, brazed connections W in the load-side heat exchanger 7 (which in this example include the brazed connections W for peripheral components such as the indoor pipe 9*a*, the header main pipe 61, the header branch pipe 62, the indoor refrigerant branch pipe 63, and the indoor pipe 9*b*) are located in the upper space 115*b*. The indoor pipes 9*a* and 9*b* are extended downward through the partition unit 20 from the upper space 115*b* to the lower space 115*a*. The fitting 15*a* that connects the indoor pipe 9*a* with the extension pipe 10*a*, and the fitting 15*b* that connects the indoor pipe 9*b* with the extension pipe 10*b* are disposed in the lower space 115*a*.

The temperature sensor 94*c* or 94*d* is provided to the indoor pipe 9*a* or 9*b* within the upper space 115*b* to detect refrigerant leakage, separately from the heat exchanger liquid pipe temperature sensor 92 and the heat exchanger two-phase pipe temperature sensor 93 that are used in controlling operation of the refrigerant circuit 40. The temperature sensor 94*c* is disposed in an area of the indoor pipe 9*a* adjacent to a brazed connection W in the load-side heat exchanger 7 while in contact with the outer peripheral surface of the indoor pipe 9*a*. For example, the temperature sensor 94*c* is disposed below and near the lowermost brazed connection W. The temperature sensor 94*d* is disposed in an area of the indoor pipe 9*b* adjacent to a brazed connection W in the load-side heat exchanger 7 while in contact with the outer peripheral surface of the indoor pipe 9*b*. For example, the temperature sensor 94*d* is disposed at least in an area located below and near the lowermost one of the brazed connections W in the indoor pipe 9*b*.

The partition unit 20, that is, a drain pan is disposed below the indoor pipe 9*a*, the header main pipe 61, the header branch pipe 62, the indoor refrigerant branch pipe 63, and the indoor pipe 9*b*. For this reason, normally there would be no particular need to provide a heat insulation material in an area of the upper space 115*b* around the indoor pipe 9*a*, the header main pipe 61, the header branch pipe 62, the indoor refrigerant branch pipe 63, and the indoor pipe 9*b*. In Embodiment 1, however, the indoor pipe 9*a*, the header main pipe 61, the header branch pipe 62, the indoor refrigerant branch pipe 63, and the indoor pipe 9*b* (at least the brazed connections W where these components are joined) that are located above (for example, directly above) the drain pan are integrally covered by, for example, a single integrated heat insulation material 82*d* (for example, a pair of heat insulation materials in close contact with each other at their jointing surface). The heat insulation material 82*d* is in close contact with these refrigerant pipes, and thus only a minute gap is present between the outer peripheral surface of each refrigerant pipe and the heat insulation material 82*d*. The heat insulation material 82*d* is attached by the manufacturer of the air-conditioning unit at the time of manufacture of the indoor unit 1.

The temperature sensor 94*c* or 94*d* is covered by the heat insulation material 82*d*, together with an associated brazed connection W in the load-side heat exchanger 7, the indoor pipe 9*a* or 9*b*, and other components or parts. That is, the temperature sensor 94*c* is disposed inside the heat insulation material 82*d*, and detects the temperature of an area of the indoor pipe 9*a* that is covered by the heat insulation material 82*d*. The temperature sensor 94*d* is disposed inside the heat insulation material 82*d*, and detects the temperature of an area of the indoor pipe 9*b* that is covered by the heat insulation material 82*d*. In this example, the heat exchanger liquid pipe temperature sensor 92 and the heat exchanger two-phase pipe temperature sensor 93 are likewise covered by the heat insulation material 82*d*.

The indoor pipe 9*a* or 9*b* within the lower space 115*a* is covered by a heat insulation material 82*b* to prevent condensation from forming, except at a location near the fitting 15*a* or 15*b*. Although the two indoor pipes 9*a* and 9*b* are collectively covered by a single heat insulation material 82*b* in this example, each of the indoor pipes 9*a* and 9*b* may be covered by a different heat insulation material. The heat insulation material 82*b* is attached by the manufacturer of the air-conditioning unit at the time of manufacture of the indoor unit 1.

The temperature sensors 94*a* and 94*b* used to detect refrigerant leakage are disposed in the lower space 115*a* separately from the suction air temperature sensor 91. The temperature sensor 94*a* is disposed in an area of the extension pipe 10*a* adjacent to the fitting 15*a* while in contact with the outer peripheral surface of the extension pipe 10*a*. For example, the temperature sensor 94*a* is disposed below and near the fitting 15*a*. The temperature sensor 94*b* is disposed in an area of the extension pipe 10*b* adjacent to the fitting 15*b* while in contact with the outer peripheral surface of the extension pipe 10*b*. For example, the temperature sensor 94*b* is disposed below and near the fitting 15*b*. In this example, the temperature sensor 94*a* or 94*b* is disposed in an area adjacent to the fitting 15*a* or 15*b* where the extension pipe 10*a* or 10*b* is connected with the indoor pipe 9*a* or 9*b*. However, instead of an area adjacent to the fitting 15*a* or 15*b*, the temperature sensor 94*a* or 94*b* may be disposed in an area adjacent to a joint where refrigerant pipes (for example, the extension pipe 10*a* and the indoor pipe 9*a*, or the extension pipe 10*b* and the indoor pipe 9*b*) are joined together by brazing, welding, or other methods.

The extension pipe 10*a* or 10*b* is covered by a heat insulation material 82*c* to prevent condensation from forming, except at a location near the fitting 15*a* or 15*b* (which in this example includes an area where the temperature sensor 94*a* or 94*b* is disposed). Although two extension pipes 10*a* and 10*b* are collectively covered by a single heat insulation material 82*c* in this example, each of the extension pipes 10*a* and 10*b* may be covered by a different heat insulation material. Generally, the extension pipes 10*a* and 10*b* are prepared by an installation contractor who installs the air-conditioning apparatus. The heat insulation material 82*c* may be already attached at the time of purchase of the extension pipes 10*a* and 10*b*. Alternatively, the installation contractor may prepare the extension pipes 10*a* and 10*b* and the heat insulation material 82*c* separately, and attach the heat insulation material 82*c* to the extension pipes 10*a* and 10*b* when installing the air-conditioning apparatus. In this example, the temperature sensor 94*a* or 94*b* is attached to the extension pipe 10*a* or 10*b* by the installation contractor.

The area of the indoor pipe 9*a* or 9*b* near the fitting 15*a* or 15*b*, the area of the extension pipe 10*a* or 10*b* near the fitting 15*a* or 15*b*, and the fitting 15*a* or 15*b* are covered by a heat insulation material 82*a* different from the heat insulation material 82*b* or 82*c* to prevent condensation from forming. The heat insulation material 82*a* is attached by the installation contractor during installation of the air-conditioning apparatus, after connecting the extension pipe 10*a* or 10*b* with the indoor pipe 9*a* or 9*b* and further attaching the temperature sensor 94*a* or 94*b* to the extension pipe 10*a* or 10*b*. The heat insulation material 82*a* often comes packaged with the indoor unit 1 that is in a ship-ready state. The heat insulation material 82*a* is in the shape of, for example, a cylinder tube split by a plane including the tube axis. The heat insulation material 82*a* is wrapped to cover an end portion of each of the heat insulation materials 82*b* and 82*c* from the outside, and attached by using a band 83. The heat insulation material 82*a* is in close contact with these refrigerant pipes, and thus only a minute gap is present between the outer peripheral surface of each refrigerant pipe and the inner peripheral surface of the heat insulation material 82*a*.

In the indoor unit 1, areas prone to refrigerant leaks are the brazed connections W in the load-side heat exchanger 7, and the joints between refrigerant pipes (the fittings 15*a* and 15*b* in this example). Generally, refrigerant that leaks to atmospheric pressure from the refrigerant circuit 40 undergoes adiabatic expansion and turns into a gas, which is dispersed into the atmosphere. As refrigerant undergoes adiabatic expansion and turns into a gas, the refrigerant takes away heat from the surrounding air or other media.

In this regard, the brazed connection W and the fitting 15*a* or 15*b*, which are prone to refrigerant leaks, is covered by the heat insulation material 82*d* or 82*a*. Consequently, when refrigerant undergoes adiabatic expansion and turns into a gas, the refrigerant is not able to take away heat from the air outside the heat insulation material 82*d* or 82*a*. Because the heat insulation material 82*d* or 82*a* has a small heat capacity, the refrigerant is not able to take away almost any heat from the heat insulation material 82*d* or 82*a*, either. Thus, the refrigerant takes away heat mainly from the refrigerant pipe. At this time, the refrigerant pipe itself is heat-insulated with the heat insulation material from the air outside the refrigerant pipe. Consequently, as the refrigerant pipe loses heat to the refrigerant, the temperature of the refrigerant pipe drops in accordance with the amount of heat lost to the refrigerant, and the refrigerant pipe is maintained at the dropped temperature. As a result, the temperature of the refrigerant pipe near the leak site drops to a cryogenic temperature approximately equal to the boiling point of the refrigerant (e.g., approximately −29 degrees C. for HFO-1234yf), with the temperature of the refrigerant pipe dropping successively also at sites remote from the leak site.

When refrigerant undergoes adiabatic expansion and turns into a gas, the resulting refrigerant can hardly disperse into the air outside the heat insulation material 82*d* or 82*a*, and builds up in the minute gap between the refrigerant pipe and the heat insulation material 82*d* or 82*a*. Then, when the temperature of the refrigerant pipe drops to the boiling point of the refrigerant, the gas refrigerant that has built up in the minute gap condenses again on the outer peripheral surface of the refrigerant pipe. Leaking refrigerant that has turned into a liquid through this re-condensation drops downward through the minute gap between the refrigerant pipe and the heat insulation material by travelling along the outer peripheral surface of the refrigerant pipe and the inner peripheral surface of the heat insulation material.

At this time, the temperature sensor 94*a*, 94*b*, 94*c*, or 94*d* detects the cryogenic temperature of the liquid refrigerant that flows down through the minute gap, or the temperature of the refrigerant pipe that has dropped to a cryogenic temperature.

The heat insulation material 82*a*, 82*b*, 82*c*, or 82*d* is preferably formed of, for example, closed-cell foamed resin (for example, foamed polyethylene). This helps keep the leaking refrigerant present in the minute gap between the refrigerant pipe and the heat insulation material from passing through the heat insulation material and leaking out to the air outside the heat insulation material. This also ensures that the resulting heat insulation material has a small heat capacity.

Figure 6:
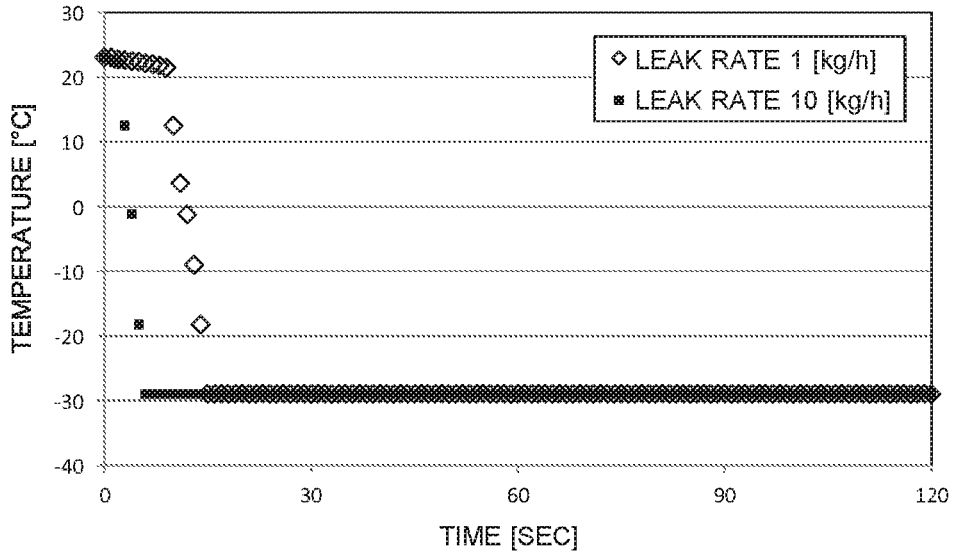
FIG. 6 is a graph illustrating exemplary time variation of the temperature detected by a temperature sensor 94*b* when refrigerant is leaked from a fitting 15*b* in the indoor unit 1 of the air-conditioning apparatus according to Embodiment 1 of the present invention.

FIG. 6 is a graph illustrating exemplary time variation of the temperature detected by the temperature sensor 94*b* when refrigerant is leaked from the fitting 15*b* in the indoor unit 1 of the air-conditioning apparatus according to Embodiment 1. The horizontal axis of the graph represents time elapsed [sec] since the start of refrigerant leakage, and the vertical axis represents temperature [degrees C.]. FIG. 6 illustrates both the time variation of temperature at a leak rate of 1 kg/h, and the time variation of temperature at a leak rate of 10 kg/h. HFO-1234yf is used as refrigerant.

As illustrated in FIG. 6, as the leaking refrigerant undergoes adiabatic expansion and turns into a gas, the temperature detected by the temperature sensor 94*b* begins to drop immediately after the start of leakage. When the refrigerant begins to liquefy due to re-condensation upon lapse of several to several tens of seconds after the start of leakage, the temperature detected by the temperature sensor 94*b* sharply drops to approximately −29 degrees C., which is the boiling point of HFO-1234yf. Thereafter, the temperature detected by the temperature sensor 94*b* is maintained at approximately −29 degrees C.

Since the refrigerant leak site is covered by a heat insulation material as described above, a temperature drop due to refrigerant leakage can be detected with no delay. Covering the refrigerant leak site with a heat insulation material also allows for responsive detection of a temperature drop resulting from refrigerant leakage, even at a relatively low leak rate of 1 kg/h.

When leakage of refrigerant ends, removal of heat from the surroundings due to adiabatic expansion of the refrigerant ceases to occur, and thus the temperature of the refrigerant pipe at the leak site begins to rise. Consequently, the temperature of the portion of the refrigerant pipe adjacent to the leak site also begins to rise successively. As a result, the temperature detected by the temperature sensor 94*b*, which is disposed in an area of the refrigerant pipe adjacent to the leak site, also begins to rise. That is, the controller 30 is able to detect the end of refrigerant leakage based on the temperature detected by the temperature sensor 94*b*.

Figure 7:
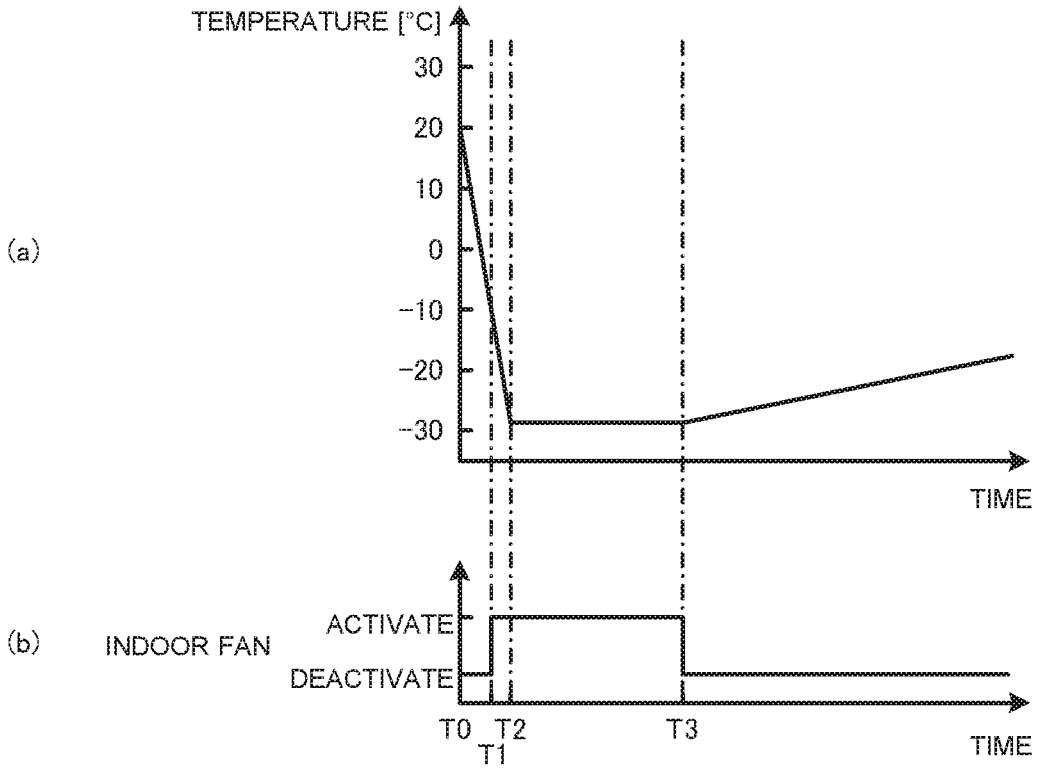
FIG. 7 is a graph illustrating exemplary operation of the indoor unit 1 of the air-conditioning apparatus according to Embodiment 1.

FIG. 7 is a graph illustrating exemplary operation of the indoor unit 1 of the air-conditioning apparatus according to Embodiment 1. FIG. 7(*a*) illustrates the time variation of the temperature detected by the temperature sensor 94*b* when refrigerant leaks from the fitting 15*b*. FIG. 7(*b*) illustrates the operation of the indoor fan 7*f* controlled by the controller 30. The horizontal axis in FIG. 7(*a*) and FIG. 7(*b*) represents elapsed time. The vertical axis in FIG. 7(*a*) represents temperature [degrees C.]. The vertical axis in FIG. 7(*b*) represents the activated or deactivated condition of the indoor fan 7*f*. It is assumed that at time T0 when leakage of refrigerant from the fitting 15*b* is started, the indoor unit 1 including the indoor fan 7*f* is in deactivated condition, and the temperature detected by the temperature sensor 94*b* is substantially equal to the room temperature (approximately 20 degrees C. in this example). HFO-1234yf is used as refrigerant.

As illustrated in FIG. 7, when leakage of refrigerant from the fitting 15*b* is started at time T0, the temperature detected by the temperature sensor 94*b* sharply drops to approximately −29 degrees C., which is the boiling point of HFO-1234yf. After dropping to approximately −29 degrees C. at time T2, the temperature detected by the temperature sensor 94*b* is maintained at approximately −29 degrees C. after time T2. Leakage of refrigerant ends when, for example, all of the refrigerant charge in the refrigerant circuit 40 has leaked out, or when a simple measure to stop the leakage is completed. Once leakage of refrigerant ends at time T3, the temperature detected by the temperature sensor 94*b* gradually rises toward the room temperature. That is, in the period from the start to end of leakage of refrigerant from the fitting 15*b* (the period from time T0 to time T3), the time variation of the temperature detected by the temperature sensor 94*b* is negative or zero. In the period after the end of leakage of refrigerant from the fitting 15*b* (the period after time T3), the time variation of the temperature detected by the temperature sensor 94*b* is positive.

If the controller 30 determines that refrigerant has leaked, the controller 30 starts the operation of the indoor fan 7*f* that is in deactivated condition (time T1). As will be described later, the controller 30 determines whether refrigerant has leaked based on information such as the temperature detected by the temperature sensor 94*b* or the time variation of the temperature detected by the temperature sensor 94*b*. After operation of the indoor fan 7*f* is started at time T1, when the time variation of the temperature detected by the temperature sensor 94*b* becomes positive from negative or zero, then with this as a trigger, the controller 30 deactivates the indoor fan 7*f* at time T3. This enables the indoor fan 7*f* to be deactivated when leakage of refrigerant ends.

Figure 8:
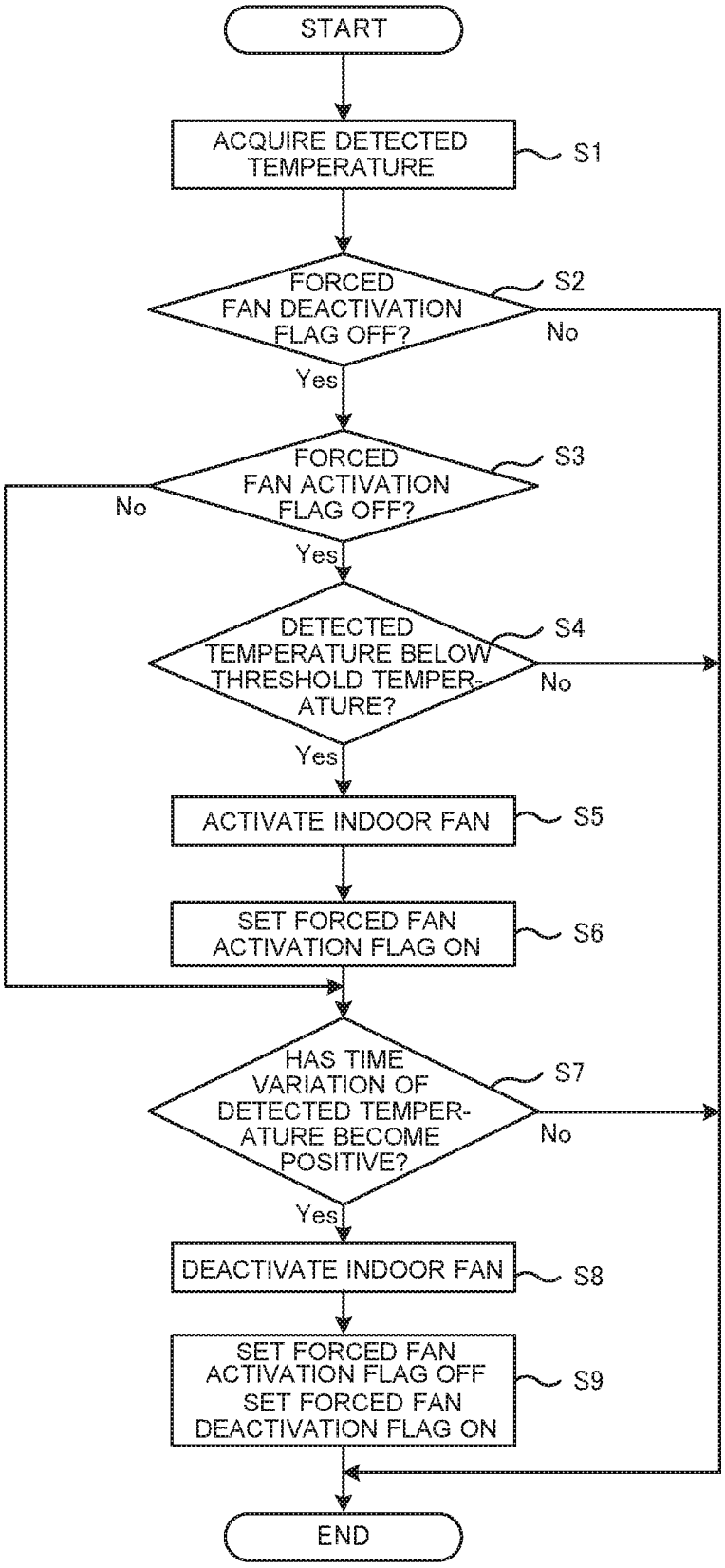
FIG. 8 is a flowchart illustrating an exemplary refrigerant leak detection process executed by a controller 30 of the air-conditioning apparatus according to Embodiment 1 of the present invention.
Figure 9:
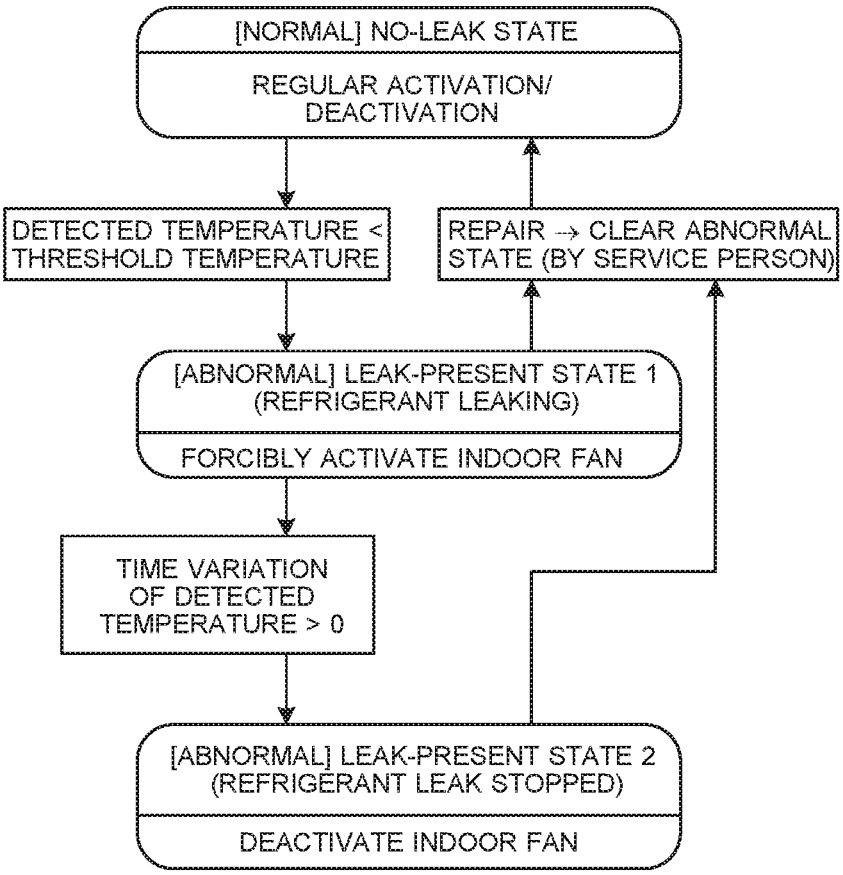
FIG. 9 is a state transition diagram illustrating exemplary state transitions of the air-conditioning apparatus according to Embodiment 1 of the present invention.

FIG. 8 is a flowchart illustrating an exemplary refrigerant leak detection process (activation and deactivation of the indoor fan 7*f*) executed by the controller 30 of the air-conditioning apparatus according to Embodiment 1. FIG. 9 is a state transition diagram illustrating exemplary state transitions of the air-conditioning apparatus according to Embodiment 1. It is desirable that the refrigerant leak detection process be repeatedly executed at predetermined time intervals only when, for example, power is being supplied to the air-conditioning apparatus (that is, when the breaker that supplies power to the air-conditioning apparatus is in ON state) and the indoor fan 7*f* is in deactivated condition. When the indoor fan 7*f* is in activated condition, indoor air is stirred, which ensures that localized increases in refrigerant concentration do not occur even if refrigerant leaks. Therefore, in Embodiment 1, the refrigerant leak detection process is executed only when the indoor fan 7*f* is in deactivated condition. However, in another possible configuration, the refrigerant leak detection process may be executed also when the indoor fan 7*f* is in activated condition. If a battery or uninterruptable power supply capable of supplying power to the indoor unit 1 is provided, the refrigerant leak detection process may be executed also when the breaker is in OFF state.

In Embodiment 1, individual refrigerant leak detection processes using the corresponding temperature sensors 94*a*, 94*b*, 94*c* and 94*d* are executed in parallel. The following description will be directed only to the refrigerant leak detection process executed by using the temperature sensor 94*b*.

First, it is assumed that the air-conditioning apparatus is initially in its normal state (No-leak state in FIG. 9). Two flag areas including a "forced fan activation flag" and a "forced fan deactivation flag" are set for the RAM of the controller 30. The forced fan activation flag and the forced fan deactivation flag are both initially set OFF. With the air-conditioning apparatus in normal state, a regular activation operation and a regular deactivation operation are performed based on a user operation made with the operating unit 26.

A step S1 in FIG. 8, the controller 30 acquires information on the temperature detected by the temperature sensor 94*b*.

Next, at step S2, it is determined whether the forced fan deactivation flag in the RAM is OFF. The process proceeds to step S3 if the forced fan deactivation flag is OFF, and the process is ended if the forced fan deactivation flag is ON.

Next, at step S3, it is determined whether the forced fan activation flag in the RAM is OFF. The process proceeds to step S4 if the forced fan activation flag is OFF, and the process proceeds to step S7 if the forced fan activation flag is ON.

At step S4, it is determined whether the temperature detected by the temperature sensor 94*b* is below a preset threshold temperature (for example, −10 degrees C.). The threshold temperature may be set to the lower limit (for example, 3 degrees C.; details in this regard will be given later) of the evaporating temperature of the load-side heat exchanger 7 in cooling operation. If it is determined that the detected temperature is below the threshold temperature, the process proceeds to step S5. If it is determined that the detected temperature is equal to or higher than the threshold temperature, the process is ended.

At step S5, operation of the indoor fan 7*f* is started (which corresponds to time T1 in FIG. 7). If the indoor fan 7*f* is already operating, the operation is continued. At step S5, a component provided in the operating unit 26, such as a display (for example, a liquid crystal screen or an LED) or a voice output unit, may be used to inform the user that leakage of refrigerant has occurred, thus prompting repair by a professional service person. For example, the controller 30 controls the display provided in the operating unit 26 to display an instruction such as "Gas has leaked. Open the window". As a result, the user is able to immediately recognize that refrigerant has leaked, and that a measure such as ventilation needs to be taken. This helps prevent localized increases in refrigerant concentration more reliably.

Next, at step S6, the forced fan activation flag is set ON. Setting the forced fan activation flag ON sets the state of the air-conditioning apparatus to a first abnormal state (Leak-present state 1 in FIG. 9 (Refrigerant Leaking)). The process then proceeds to step S7.

At step S7, it is determined whether the time variation of the detected temperature has become positive from negative or zero. If it is determined that the time variation of the detected temperature has become positive, the process proceeds to step S8. Otherwise, the process is ended.

At step S8, the indoor fan 7*f* is deactivated (which corresponds to time T3 in FIG. 7).

Next, at step S9, the forced fan activation flag is set OFF, and the forced fan deactivation flag is set ON. Setting the forced fan deactivation flag ON sets the state of the air-conditioning apparatus to a second abnormal state (Leak-present state 2 in FIG. 9 (Refrigerant Leak Stopped)).

As described above, in the refrigerant leak detection process illustrated in FIG. 8, operation of the indoor fan 7*f* is started when leakage of refrigerant is detected (that is, when the temperature detected by the temperature sensor 94*b* falls below a threshold temperature). This enables dispersion of the leaking refrigerant in the indoor space. The operation of the indoor fan 7*f* is continued until the leakage of refrigerant ends. This helps minimize localized increases in indoor refrigerant concentration in the event of refrigerant leakage. This ensures that formation of flammable concentration regions is prevented even if a flammable refrigerant is used.

In accordance with the refrigerant leak detection process illustrated in FIG. 8, the indoor fan 7*f* can be triggered to deactivate in response to the end of refrigerant leakage. This helps prevent unnecessary energy consumption. This also helps avoid unnecessary user concerns that may be otherwise caused by continued operation of the indoor fan 7*f*. Once refrigerant leakage ends, normally the indoor refrigerant concentration gradually drops and does not rise again. This also helps prevent localized increases in refrigerant concentration from occurring after the indoor fan 7*f* is deactivated.

In accordance with the refrigerant leak detection process illustrated in FIG. 8, once the forced fan activation flag or the forced fan deactivation flag is set ON, then under no circumstances both the forced fan activation flag and the forced fan deactivation flag are set OFF. Therefore, as illustrated in FIG. 9, once set in Leak-present state 1 or Leak-present state 2, the state of the air-conditioning apparatus does not return to the No-leak state unless a service person repairs the air-conditioning apparatus and then clears the abnormal state (sets the forced fan deactivation flag OFF).

In Embodiment 1, of the three states illustrated in FIG. 9 (No-leak state, Leak-present state 1, and Leak-present state 2), regular operation is possible only in No-leak state. In Leak-present state 1 and Leak-present state 2, the compressor 3 is in forced deactivation (activation-disabled) condition.

In Embodiment 1, an abnormal state can be cleared by a method that can be performed only by a professional service person. This prevents the user from clearing an abnormal state even through the air-conditioning apparatus is not repaired, thus insuring the safety of the air-conditioning apparatus. Examples of the methods for clearing an abnormal state are limited to the following three methods.

(1) Use of a dedicated checker (2) Special operation on the operating unit 26

(3) Operation of a switch mounted on the control board of the controller 30

To prevent the user from clearing an abnormal state, it is desirable to allow an abnormal state to be cleared only by the method (1).

Although in Embodiment 1 the determination of whether refrigerant has leaked is made based on the temperature detected by the temperature sensor 94*b*, the determination of whether refrigerant has leaked may be made based on the time variation of the temperature detected by the temperature sensor 94*b*. For example, refrigerant is determined to have leaked if the time variation of the temperature detected by the temperature sensor 94*b* falls below a preset threshold (for example, −20 degrees C./min). If the temperature detected by the temperature sensor 94*b* is to be acquired every one minute, a value obtained by subtracting the detected temperature acquired one minute ago from the detected temperature acquired at the present time may serve as the time variation of the detected temperature. It is to be noted that when a detected temperature is falling, the time variation of the detected temperature takes on a negative value. Therefore, when a detected temperature is falling, the time variation of the detected temperature decreases as the detected temperature changes more rapidly.

Next, another exemplary refrigerant leak detection process will be described. Each of the temperature sensors used is a thermistor whose electrical resistance changes with varying temperature. The electrical resistance of a thermistor decreases with increasing temperature, and increases with decreasing temperature. A fixed resistor connected in series with the thermistor is mounted on the board. A DC voltage of, for example, 5 V is applied to each of the thermistor and the fixed resistor. Since the electrical resistance of a thermistor changes with temperature, the voltage (divided voltage) applied to the thermistor changes with temperature. The controller 30 acquires the temperature detected by each temperature sensor by converting the value of voltage applied to the thermistor into a temperature.

The range of resistances of a thermistor is set based on the range of temperatures to be detected. In some cases, if a voltage applied to the thermistor lies outside a voltage range corresponding to the range of temperatures to be detected, the controller 30 detects an error indicating that the corresponding temperature lies outside the range of temperatures to be detected.

With the configuration illustrated in FIGS. 3 to 5 or other figures, the temperature sensors (for example, the heat exchanger liquid pipe temperature sensor 92 and the heat exchanger two-phase pipe temperature sensor 93) that detect the temperature of refrigerant in the load-side heat exchanger 7, and the temperature sensors 94*a*, 94*b*, 94*c*, and 94*d* used to detect refrigerant leakage are provided independently from each other. In another possible configuration, for example, the heat exchanger liquid pipe temperature sensor 92 may double as the temperature sensor 94*d* used to detect refrigerant leakage. Since the heat exchanger liquid pipe temperature sensor 92 is covered by the same heat insulation material 82*d* that covers an associated brazed connection W, and is disposed in an area that is thermally continuous to the brazed connection W via the refrigerant pipe, the heat exchanger liquid pipe temperature sensor 92 is able to detect a cryogenic temperature phenomenon occurring in the vicinity of the brazed connection W.

The range of temperatures to be detected by the temperature sensor that detects the temperature of refrigerant in the load-side heat exchanger 7 is set based on the range of temperatures in the load-side heat exchanger 7 during regular operation. For example, to protect the load-side heat exchanger 7 against freezing, the refrigerant circuit 40 is controlled such that the evaporating temperature in cooling operation does not drop to a temperature equal to or lower than 3 degrees C. Further, for example, to prevent and protect against an excessive increase in condensing temperature (condensing pressure) in order to prevent breakdown of the compressor 3, the refrigerant circuit 40 is controlled such that the condensing temperature in heating operation does not rise to a temperature equal to or higher than 60 degrees C. In this case, the temperature range for the load-side heat exchanger 7 is from 3 degrees C. to 60 degrees C. during regular operation.

As described above, in accordance with Embodiment 1, leakage of refrigerant results in a temperature sensor near the leak site detecting a cryogenic temperature that greatly differs from the range of temperatures of the load-side heat exchanger 7. In this case, in response to detection of an error indicating that the detected temperature lies outside the range of temperatures to be detected by the temperature sensor, the controller 30 may determine that a cryogenic temperature has been detected by the temperature sensor, and accordingly determine that refrigerant has leaked.

As with the configuration illustrated in FIGS. 3 to 5 or other figures, the above-mentioned configuration ensures reliable and responsive detection of refrigerant leakage over an extended period of time. Further, the above-mentioned configuration also helps reduce the number of temperature sensors, thus allowing for reduced manufacturing cost of the air-conditioning apparatus.

Next, a modification of the refrigeration cycle apparatus according to Embodiment 1 will be described. Although the temperature sensor 94*a*, 94*b*, 94*c*, or 94*d* is disposed below an associated brazed connection W or an associated joint (for example, the fitting 15*a* or 15*b*) in accordance with the configuration illustrated in FIGS. 3 to 5 or other figures, the temperature sensor 94*a*, 94*b*, 94*c*, or 94*d* may be disposed above or laterally to an associated brazed connection W or an associated joint. For example, the temperature sensor 94*a* or 94*b* may be disposed in an area of the indoor pipe 9*a* or 9*b* within the lower space 115*a* illustrated in FIG. 5 located above or laterally to the fitting 15*a* or 15*b* and covered by the heat insulation material 82*b* (for example, in an area further covered by the heat insulation material 82*a*). As a result, the temperature sensor 94*a* or 94*b* can be attached to the indoor pipe 9*a* or 9*b* by the manufacturer of the air-conditioning unit. This eliminates the need to attach the temperature sensor 94*a* or 94*b* at the time of installation of the air-conditioning apparatus, thus improving the ease of installation.

Only a minute gap is present between the outer peripheral surface of the indoor pipe 9*a* or 9*b* and the inner peripheral surface of the heat insulation material 82*a* or 82*b*. Thus, the refrigerant at a cryogenic temperature that has turned into a liquid through re-condensation near the fitting 15*a* or 15*b* travels not only downward but also upward and sideways due to capillary action. Accordingly, even if the temperature sensor 94*a* or 94*b* is disposed above or laterally to the fitting 15*a* or 15*b*, the temperature sensor 94*a* or 94*b* is able to detect the cryogenic temperature of refrigerant.

In another possible configuration, for example, the heat exchanger two-phase pipe temperature sensor 93 may double as the temperature sensor 94*d* used to detect refrigerant leakage.

For instance, refrigerant at a cryogenic temperature that has leaked at a given brazed connection W and turned into a liquid through re-condensation travels within the heat insulation material 82*d* due to capillary action, along the minute gap between the heat insulation material 82*d* and the refrigerant pipe, or along the minute gap between the jointing surfaces of two heat insulation materials 82*d*. The heat exchanger two-phase pipe temperature sensor 93 is integrally covered by the same heat insulation material 82*d* that covers the brazed connections W in components such as the U-bent tube 73 to which the heat exchanger two-phase pipe temperature sensor 93 is provided, the other U-bent tubes 73, the indoor pipes 9*a* and 9*b*, and the header main pipe 61. This configuration enables the heat exchanger two-phase pipe temperature sensor 93 to detect the cryogenic temperature of refrigerant that has leaked at each brazed connection W covered by the heat insulation material 82*d*.

As described above, the refrigeration cycle apparatus according to Embodiment 1 includes the refrigerant circuit 40 through which refrigerant is circulated, a heat exchanger unit (for example, the indoor unit 1 or the outdoor unit 2) that accommodates a heat exchanger (for example, the load-side heat exchanger 7 or the heat source-side heat exchanger 5) of the refrigerant circuit 40 and a fan (for example, the indoor fan 7*f* or the outdoor fan 5*f*), a temperature sensor (for example, the temperature sensor 94*a*, 94*b*, 94*c*, or 94*d*) disposed in an area of the refrigerant circuit 40 adjacent to a brazed connection (for example, a brazed connection W in the load-side heat exchanger 7 or a brazed connection in the heat source-side heat exchanger 5), or in an area of the refrigerant circuit 40 adjacent to a joint between refrigerant pipes (for example, the fitting 15*a*, 15*b*, 16*a*, or 16*b*), and the controller 30 configured to determine the presence of refrigerant leakage based on the temperature detected by the temperature sensor. The temperature sensor is covered by a heat insulation material (for example, the heat insulation material 82*a*, 82*b*, or 82*d*) together with an associated brazed connection or an associated joint. The controller 30 is configured such that the controller 30 activates the fan upon determining that refrigerant leakage is present, and is triggered to deactivate the fan in response to the time variation of the temperature detected by the temperature sensor becoming positive.

With the above-mentioned configuration, the temperature sensor 94*a*, 94*b*, 94*c*, or 94*d* having long-term reliability can be used as a refrigerant detection unit, thus enabling reliable detection of refrigerant leakage over an extended period of time. Further, according to the above-mentioned configuration, the temperature sensor 94*a*, 94*b*, 94*c*, or 94*d* is covered by the heat insulation material 82*a*, 82*b*, or 82*d* together with an associated brazed connection or an associated joint. As a result, a temperature drop due to leakage of refrigerant at the brazed connection or the joint can be detected with no delay. This allows for responsive detection of refrigerant leakage.

Further, with the above-mentioned configuration, the fan can be triggered to deactivate in response to the end of refrigerant leakage. This helps prevent unnecessary energy consumption. Once refrigerant leakage ends, normally the indoor refrigerant concentration gradually drops and does not rise again. This also helps prevent localized increases in refrigerant concentration from occurring after the indoor fan is deactivated.

In another possible configuration of the refrigeration cycle apparatus according to Embodiment 1, the heat exchanger, the fan, the brazed connection or the joint, the temperature sensor, and the heat insulation material are accommodated in the same heat exchanger unit (for example, the indoor unit 1 or the outdoor unit 2).

In another possible configuration of the refrigeration cycle apparatus according to Embodiment 1, the controller 30 determines that refrigerant has leaked if a detected temperature falls below a threshold temperature.

In another possible configuration of the refrigeration cycle apparatus according to Embodiment 1, the controller 30 determines that refrigerant has leaked if the time variation of a detected temperature falls below a threshold.

In another possible configuration of the refrigeration cycle apparatus according to Embodiment 1, the refrigeration cycle apparatus further includes the indoor fan 7*f* that sends air indoors, and the controller 30 determines the presence of refrigerant leakage only when the indoor fan 7*f* is in deactivated condition.

In another possible configuration of the refrigeration cycle apparatus according to Embodiment 1, the temperature sensor 94*a*, 94*b*, 94*c*, or 94*d* is located below an associated brazed connection or an associated joint.

In another possible configuration of the refrigeration cycle apparatus according to Embodiment 1, the temperature sensor 94*a*, 94*b*, 94*c*, or 94*d* is located above or laterally to an associated brazed connection or an associated joint.

In another possible configuration of the refrigeration cycle apparatus according to Embodiment 1, the temperature sensor that detects the temperature of refrigerant in the heat exchanger (for example, the liquid pipe temperature or two-phase pipe temperature) doubles as the temperature sensor 94*a*, 94*b*, 94*c*, or 94*d*.

In another possible configuration of the refrigeration cycle apparatus according to Embodiment 1, the temperature sensor 94*a*, 94*b*, 94*c*, or 94*d* is covered by the same heat insulation material 82*a*, 82*b*, or 82*d* that covers an associated brazed connection or an associated joint.

Embodiment 2

Figure 10:
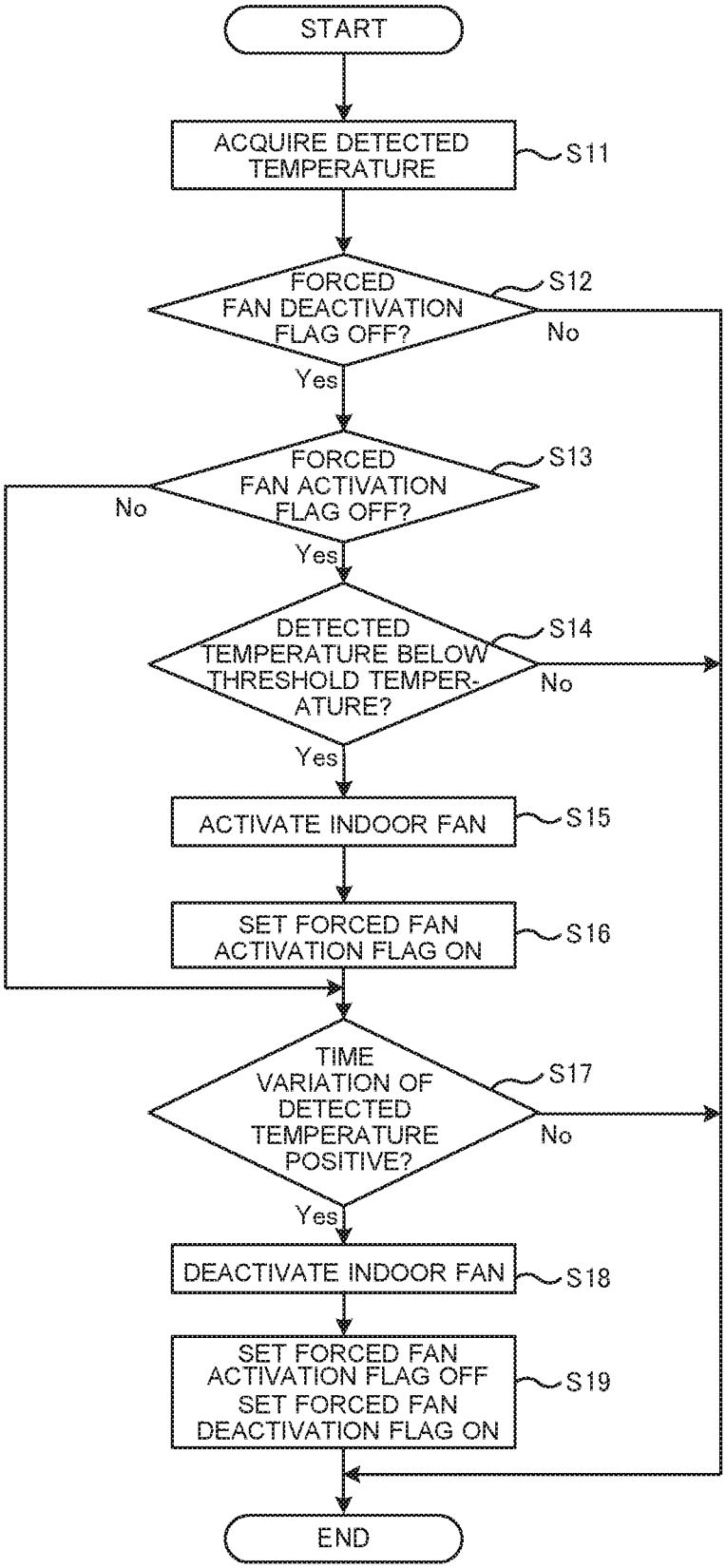
FIG. 10 is a flowchart illustrating an exemplary refrigerant leak detection process executed by the controller 30 of an air-conditioning apparatus according to Embodiment 2 of the present invention.

A refrigeration cycle apparatus according to Embodiment 2 of the present invention will be described below. The configuration of the refrigeration cycle apparatus according to Embodiment 2 is the same as in Embodiment 1, and thus will not be described in further detail. FIG. 10 is a flowchart illustrating an exemplary refrigerant leak detection process executed by the controller 30 of an air-conditioning apparatus according to Embodiment 2. The refrigerant leak detection process illustrated in FIG. 10 is repeatedly executed at predetermined time intervals either on a constant basis, including when the air-conditioning apparatus is in activated condition and when the air-conditioning apparatus is in deactivated condition, or only when the air-conditioning apparatus is in deactivated condition. Steps S11 to S16, S18, and S19 in FIG. 10 are respectively the same as steps S1 to S6, S8, and S9 in FIG. 8.

At step S17 in FIG. 10, it is determined whether the time variation of the temperature detected by the temperature sensor 94*b* is positive (that is, whether the temperature detected by the temperature sensor 94*b* is rising). If it is determined that the time variation of the detected temperature is positive, the process proceeds to step S18. Otherwise, the process is ended.

As previously described, when refrigerant leakage ends, the time variation of the temperature detected by the temperature sensor 94*b* changes to positive from negative or zero. Accordingly, whether refrigerant leakage has ended can be determined also by determining whether the time variation of the detected temperature is positive as in Embodiment 2.

As described above, the refrigeration cycle apparatus according to Embodiment 2 includes the refrigerant circuit 40 through which refrigerant is circulated, a heat exchanger unit (for example, the indoor unit 1 or the outdoor unit 2) that accommodates a heat exchanger (for example, the load-side heat exchanger 7 or the heat source-side heat exchanger 5) of the refrigerant circuit 40 and a fan (for example, the indoor fan 7*f* or the outdoor fan 5*f*), a temperature sensor (for example, the temperature sensor 94*a*, 94*b*, 94*c*, or 94*d*) disposed in an area of the refrigerant circuit 40 adjacent to a brazed connection (for example, a brazed connection W in the load-side heat exchanger 7 or a brazed connection in the heat source-side heat exchanger 5), or in an area of the refrigerant circuit 40 adjacent to a joint between refrigerant pipes (for example, the fitting 15*a*, 15*b*, 16*a*, or 16*b*), and the controller 30 configured to determine the presence of refrigerant leakage based on the temperature detected by the temperature sensor. The temperature sensor is covered by a heat insulation material (for example, the heat insulation material 82*a*, 82*b*, or 82*d*) together with an associated brazed connection or an associated joint. The controller 30 is configured to activate the fan upon determining that refrigerant leakage is present, and deactivate the fan when the time variation of the temperature detected by the temperature sensor is positive.

With the above-mentioned configuration, the temperature sensor 94*a*, 94*b*, 94*c*, or 94*d* having long-term reliability can be used as a refrigerant detection unit, thus enabling reliable detection of refrigerant leakage over an extended period of time. Further, according to the above-mentioned configuration, the temperature sensor 94*a*, 94*b*, 94*c*, or 94*d* is covered by the heat insulation material 82*a*, 82*b*, or 82*d* together with an associated brazed connection or an associated joint. As a result, a temperature drop due to leakage of refrigerant at the brazed connection or the joint can be detected with no delay. This allows for responsive detection of refrigerant leakage.

Further, with the above-mentioned configuration, the fan can be triggered to deactivate in response to the end of refrigerant leakage. This helps prevent unnecessary energy consumption. Once refrigerant leakage ends, normally the indoor refrigerant concentration gradually drops and does not rise again. This also helps prevent localized increases in refrigerant concentration from occurring after the indoor fan is deactivated.

Embodiment 3

Figure 11:
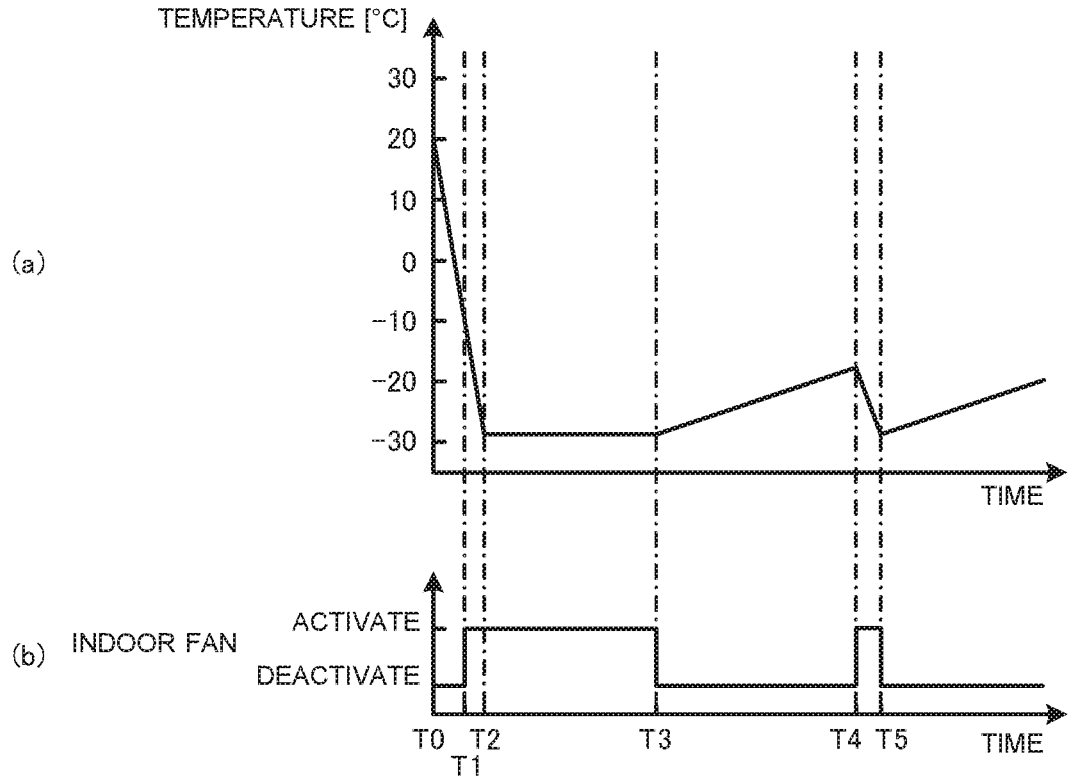
FIG. 11 is a graph illustrating exemplary operation of the indoor unit 1 of an air-conditioning apparatus according to Embodiment 3 of the present invention.

Next, a refrigeration cycle apparatus according to Embodiment 3 of the present invention will be described. The configuration of the refrigeration cycle apparatus according to Embodiment 3 is the same as in Embodiment 1, and thus will not be described in further detail. FIG. 11 is a graph illustrating exemplary operation of the indoor unit 1 of an air-conditioning apparatus according to Embodiment 3. FIG. 11(*a*) illustrates the time variation of the temperature detected by the temperature sensor 94*b* when refrigerant is leaked from the fitting 15*b*. FIG. 11(*b*) illustrates the operation of the indoor fan 7*f* controlled by the controller 30. The horizontal axis in FIG. 11(*a*) and FIG. 11(*b*) represents elapsed time. The vertical axis in FIG. 11(*a*) represents temperature [degrees C.]. The vertical axis in FIG. 11(*b*) represents the activated or deactivated condition of the indoor fan 7*f*. It is assumed that at time T0 when leakage of refrigerant from the fitting 15*b* is started, the indoor unit 1 including the indoor fan 7*f* is in deactivated condition, and the temperature detected by the temperature sensor 94*b* is substantially equal to the room temperature (approximately 20 degrees C. in this example). HFO-1234yf is used as refrigerant. In FIG. 11, the time variation of temperature from time T0 to time T4, and operation of the indoor fan 7*f* are the same as those in FIG. 7.

In some instances, a non-uniform distribution of refrigerant within the refrigerant circuit 40 causes the rate of refrigerant leakage (the mass flow rate of leakage) to change with time. Consequently, in some instances, refrigerant leakage starts again after refrigerant leakage ends once. In the example illustrated in FIG. 11, at time T4 after time T3 at which refrigerant leakage ends once, leakage of refrigerant from the fitting 15*b* resumes, and the resumed refrigerant leakage ends at time T5. Thus, the time variation of the temperature detected by the temperature sensor 94*b* is negative during the period from time T4 to time T5, and is positive during the period after time T5. In Embodiment 3, the controller 30 resumes operation of the indoor fan 7*f* at time T4 when refrigerant leakage resumes, and deactivates the indoor fan 7*f* at time T5 when the refrigerant leakage ends. In the example illustrated in FIG. 11, refrigerant leakage ends simultaneously with or before the dropping of the detected temperature to approximately −29 degrees C. The time variation of the detected temperature thus changes from negative to positive at time T5.

Figure 12:
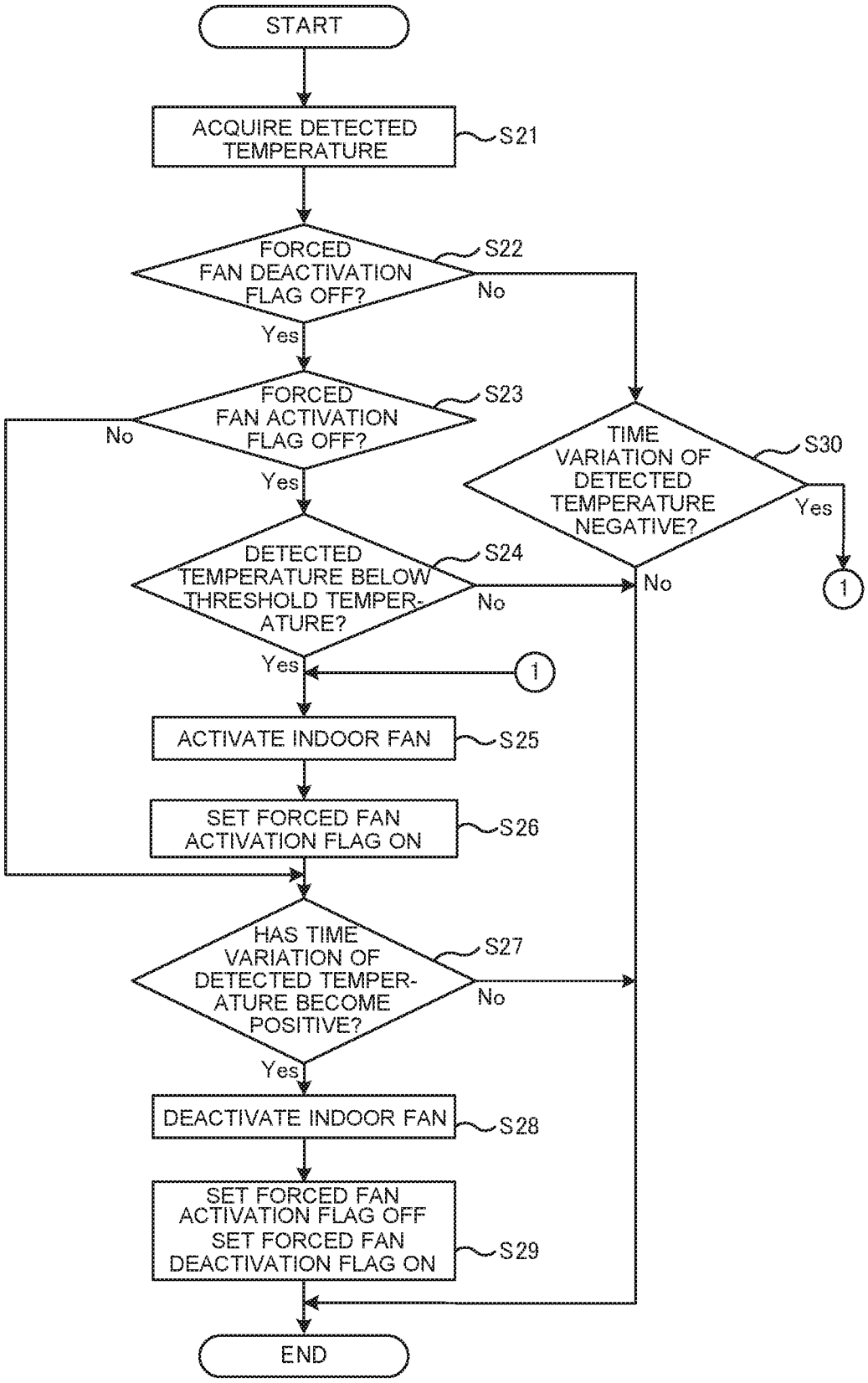
FIG. 12 is a flowchart illustrating an exemplary refrigerant leak detection process executed by the controller 30 of the air-conditioning apparatus according to Embodiment 3 of the present invention.
Figure 13:
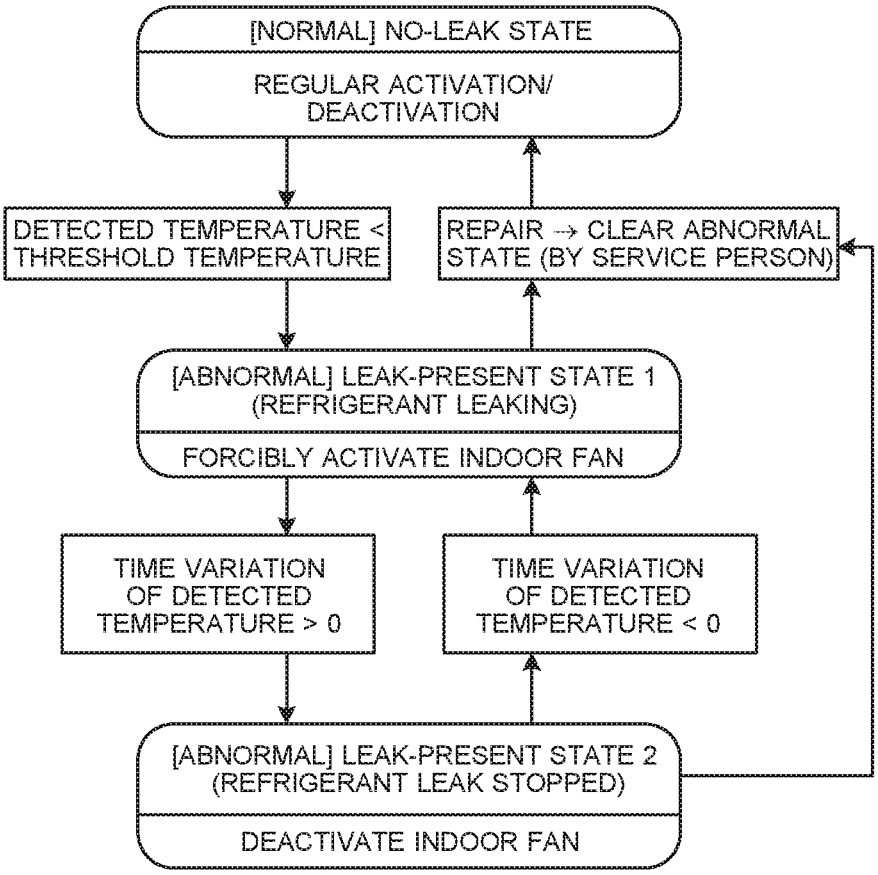
FIG. 13 is a state transition diagram illustrating exemplary state transitions of the air-conditioning apparatus according to Embodiment 3 of the present invention.

FIG. 12 is a flowchart illustrating an exemplary refrigerant leak detection process executed by the controller 30 of the air-conditioning apparatus according to Embodiment 3. The refrigerant leak detection process illustrated in FIG. 12 is repeatedly executed at predetermined time intervals either on a constant basis, including when the air-conditioning apparatus is in activated condition and when the air-conditioning apparatus is in deactivated condition, or only when the air-conditioning apparatus is in deactivated condition. Steps S21 to S25 and steps S27 to S29 in FIG. 12 are respectively the same as steps S1 to S5 and steps S7 to S9 in FIG. 8. FIG. 13 is a state transition diagram illustrating exemplary state transitions of the air-conditioning apparatus according to Embodiment 3.

In Embodiment 3, with the forced fan deactivation flag set ON (No at step S22 in FIG. 12: Leak-present state 2 in FIG. 13), it is determined whether the time variation of the temperature detected by the temperature sensor 94*b* is negative (step S30 in FIG. 12). If it is determined at step S30 that the time variation of the detected temperature is negative, the process proceeds to step S25 where the operation of the deactivated indoor fan 7*f* is resumed. Thereafter, at step S26, the forced fan deactivation flag is set OFF, and the forced fan activation flag is set ON. Setting the forced fan activation flag ON causes the state of the air-conditioning apparatus to transition from Leak-present state 2 to Leak-present state 1 in FIG. 13. If it is determined at step S30 that the time variation of the detected temperature is still positive, the process is ended.

As described above, the refrigeration cycle apparatus according to Embodiment 3 may be configured such that the controller 30 is triggered to activate a deactivated fan again in response to the time variation of the temperature detected by the temperature sensor becoming negative.

In another possible configuration of the refrigeration cycle apparatus according to Embodiment 3, the controller 30 activates a deactivated fan again when the time variation of the temperature detected by the temperature sensor is negative.

According to the configurations mentioned above, even if the fan is deactivated before refrigerant leakage ends completely, the fan can be activated again when refrigerant leakage resumes.

Embodiment 4

Next, a refrigeration cycle apparatus according to Embodiment 4 of the present invention will be described. The configuration of the refrigeration cycle apparatus according to Embodiment 4 is the same as in Embodiment 1, and thus will not be described in further detail. If, as described above, the indoor fan 7*f* is triggered to deactivate in response to the time variation of a detected temperature becoming positive, or if the indoor fan 7*f* is deactivated when the time variation of the detected temperature is positive, it is possible that the indoor fan 7*f* is deactivated before refrigerant leakage ends completely.

Accordingly, Embodiment 3 adds the following condition as the condition for deactivating the indoor fan 7*f*: the time variation of a detected temperature remains positive (that is, a detected temperature keeps rising) for a time equal to or greater than a preset threshold time. The threshold time is set to, for example, a time longer than the period of time from time T3 to time T4 illustrated in FIG. 11 (for example, several seconds to several minutes).

Figure 14:
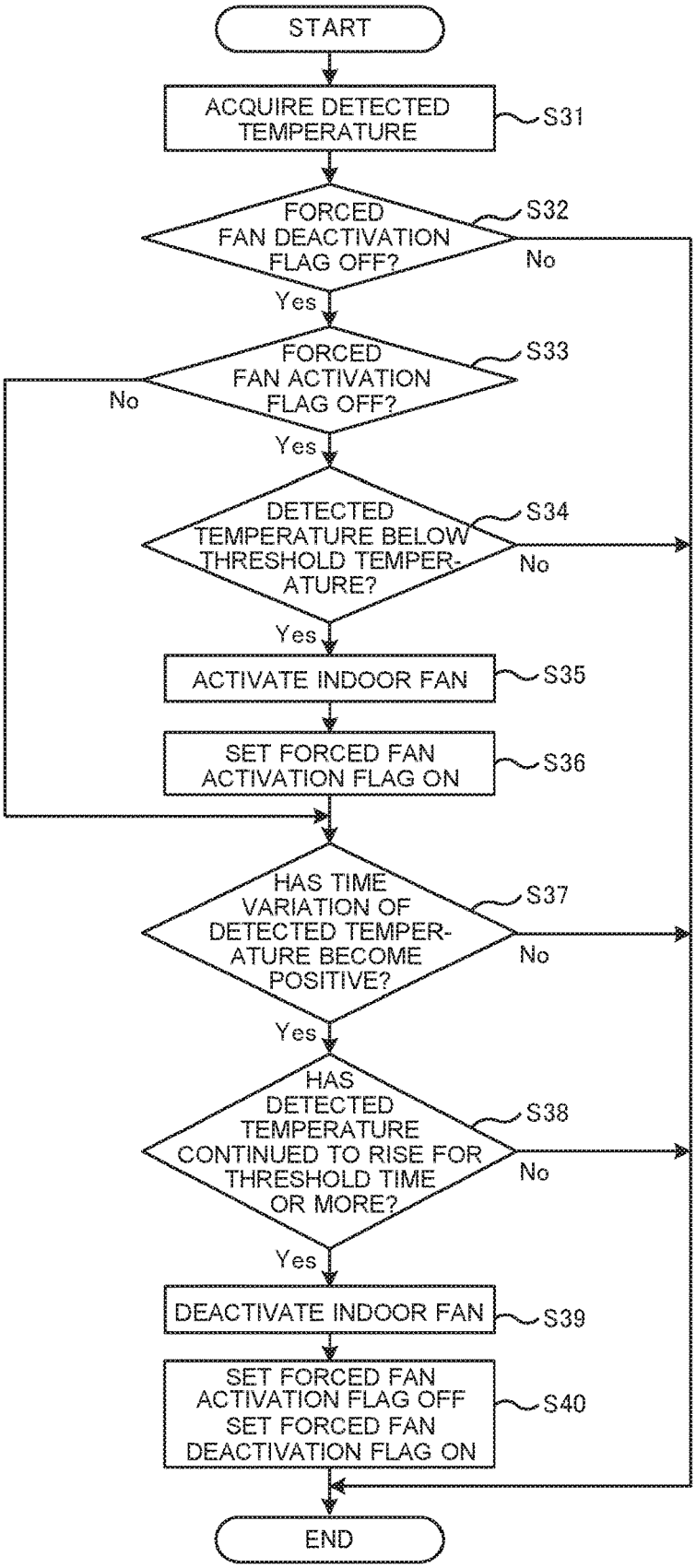
FIG. 14 is a flowchart illustrating an exemplary refrigerant leak detection process executed by the controller 30 of an air-conditioning apparatus according to Embodiment 4 of the present invention.
Figure 15:
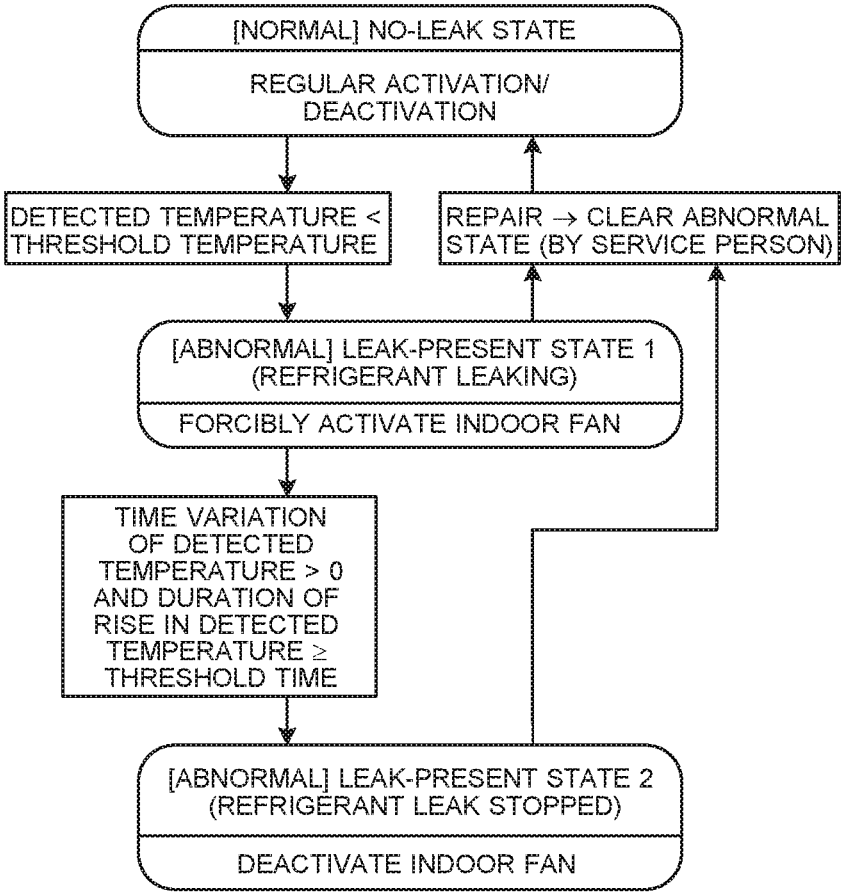
FIG. 15 is a state transition diagram illustrating exemplary state transitions of the air-conditioning apparatus according to Embodiment 4 of the present invention.

FIG. 14 is a flowchart illustrating an exemplary refrigerant leak detection process executed by the controller 30. The refrigerant leak detection process illustrated in FIG. 14 is repeatedly executed at predetermined time intervals either on a constant basis, including when the air-conditioning apparatus is in activated condition and when the air-conditioning apparatus is in deactivated condition, or only when the air-conditioning apparatus is in deactivated condition. Steps S31 to S37, S39, and S40 in FIG. 14 are respectively the same as steps S1 to S9 in FIG. 8. FIG. 15 is a state transition diagram illustrating exemplary state transitions of an air-conditioning apparatus according to Embodiment 4.

In Embodiment 4, if the time variation of the detected temperature becomes positive (Yes at step S37) while the forced fan activation flag is ON (step S37 in FIG. 14; Leak-present state 1 in FIG. 15), it is further determined whether the detected temperature has continued to rise for a time equal to or greater than a threshold time (step S38). If it is determined at step S38 that the detected temperature has continued to rise for a time equal to or greater than a threshold time, the process proceeds to step S39 where the indoor fan 7*f* is deactivated. Thereafter, at step S40, the forced fan activation flag is set OFF, and the forced fan deactivation flag is set ON. Setting the forced fan deactivation flag ON sets the state of the air-conditioning apparatus to Leak-present state 2 illustrated in FIG. 14. If it is determined at step S38 that the detected temperature has not continued to rise for a time equal to or greater than a threshold time, the process is ended.

As described above, the refrigeration cycle apparatus according to Embodiment 3 may be configured such that the controller 30 deactivates the fan when the time variation of the temperature detected by the temperature sensor remains positive for a time equal to or greater than a threshold time.

This configuration ensures that the fan is not deactivated before refrigerant leakage ends completely.

Other Embodiments

The present invention is not limited to the above embodiments but capable of various modifications.

For example, although the above embodiments are directed to a case in which the indoor unit 1 is of a floor-standing type, the present invention is also applicable to other types of indoor units, such as ceiling cassette type, ceiling concealed type, ceiling suspended type, and wall-mounted type indoor units.

Although the above embodiments are directed to a case in which the temperature sensor used to detect refrigerant leakage is disposed in the indoor unit 1, the temperature sensor used to detect refrigerant leakage may be disposed in the outdoor unit 2. In this case, the temperature sensor used to detect refrigerant leakage is disposed in an area adjacent to a brazed connection in the heat source-side heat exchanger 5 or other components, and is covered by a heat insulation material together with the brazed connection. Alternatively, the temperature sensor used to detect refrigerant leakage is disposed in an area within the outdoor unit 2 adjacent to a joint between refrigerant pipes, and is covered by a heat insulation material together with the joint. The controller 30 determines the presence of refrigerant leakage based on the temperature detected by the temperature sensor used to detect refrigerant leakage. This configuration allows for reliable and responsive detection of refrigerant leakage in the outdoor unit 2 over an extended period of time.

Although brazed connections in the refrigerant circuit 40 mainly include brazed connections W in the load-side heat exchanger 7 and brazed connections in the heat source-side heat exchanger 5 in the above embodiments, brazed connections according to the present invention are not limited to these. In the refrigerant circuit 40, brazed connections exist not only in the load-side heat exchanger 7 and the heat source-side heat exchanger 5 but also in other areas, such as between the indoor pipe 9*a* or 9*b* and the fitting 15*a* or 15*b* within the indoor unit 1, between the suction pipe 11 and the compressor 3 within the outdoor unit 2, and between the discharge pipe 12 and the compressor 3 within the outdoor unit 2. Accordingly, the temperature sensor used to detect refrigerant leakage may be disposed in an area of the refrigerant circuit 40 adjacent to a brazed connection in a component other than the load-side heat exchanger 7 and the heat source-side heat exchanger 5, and covered by a heat insulation material together with the brazed connection. This configuration also allows for reliable and responsive detection of refrigerant leakage in the refrigerant circuit 40 over an extended period of time.

Although joints in the refrigerant circuit 40 mainly include the fittings 15*a* and 15*b* in the indoor unit 1 in the above embodiments, joints according to the present invention are not limited to these. Other examples of joints in the refrigerant circuit 40 include the fittings 16*a* and 16*b* in the outdoor unit 2. Accordingly, the temperature sensor used to detect refrigerant leakage may be disposed in an area of the refrigerant circuit 40 adjacent to a joint (for example, the fitting 16*a* or 16*b*) other than the fitting 15*a* or 15*b*, and covered by a heat insulation material together with the joint. This configuration also allows for reliable and responsive detection of refrigerant leakage in the refrigerant circuit 40 over an extended period of time.

Although an air-conditioning apparatus has been described in the above embodiments as an example of a refrigeration cycle apparatus, the present invention is also applicable to other types of refrigeration cycle apparatuses, such as heat pump water heaters, chillers, or showcases.

The above-mentioned embodiments and modifications may be practiced in combination with each other.

REFERENCE SIGNS LIST

1 indoor unit 2 outdoor unit 3 compressor 4 refrigerant flow switching device 5 heat source-side heat exchanger 5*f* outdoor fan 6 pressure reducing device 7 load-side heat exchanger 7*f* indoor fan 9*a*, 9*b* indoor pipe 10*a*, 10*b* extension pipe 11 suction pipe 12 discharge pipe 13*a*, 13*b* extension-pipe connection valve 14*a*, 14*b*, 14*c* service port 15*a*, 15*b*, 16*a*, 16*b* fitting 20 partition unit 20*a* air passage opening 25 electrical component box 26 operating unit 30 controller 40 refrigerant circuit 61 header main pipe 62 header branch pipe 63 indoor refrigerant branch pipe 70 fin 71 heat transfer pipe 71*a*, 71*b* end portion 72 hairpin tube 73 U-bent tube 81 air passage 82*a*, 82*b*, 82*c*, 82*d* heat insulation material 83 band 91 suction air temperature sensor 92 heat exchanger liquid pipe temperature sensor 93 heat exchanger two-phase pipe temperature sensor 94*a*, 94*b*, 94*c*, 94*d* temperature sensor 107 impeller 108 fan casing 108*a* air outlet opening 108*b* air inlet opening 111 housing 112 air inlet 113 air outlet 114*a* first front panel 114*b* second front panel 114*c* third front panel 115*a* lower space 115*b* upper space W brazed connection

The invention claimed is:

1. A refrigeration cycle apparatus comprising:

a refrigerant circuit through which refrigerant is circulated;

a heat exchanger unit accommodating a heat exchanger of the refrigerant circuit, and a fan;

a temperature sensor disposed in an area of the refrigerant circuit adjacent to a brazed connection, or in an area of the refrigerant circuit adjacent to a joint between refrigerant pipes; and a controller configured to determine presence of refrigerant leakage based on a temperature detected by the temperature sensor, the temperature sensor being covered by a heat insulation material together with the brazed connection or the joint, the controller being configured to activate the fan upon determining that refrigerant leakage is present, and be triggered to deactivate the fan in response to a rate of change over time of the temperature detected by the temperature sensor becoming positive.

2. The refrigeration cycle apparatus of claim 1, wherein the controller is configured to be triggered to activate the deactivated fan again in response to the rate of change over time of the temperature detected by the temperature sensor becoming negative.

3. A refrigeration cycle apparatus comprising:

a refrigerant circuit through which refrigerant is circulated;

a heat exchanger unit accommodating a heat exchanger of the refrigerant circuit, and a fan;

a temperature sensor disposed in an area of the refrigerant circuit adjacent to a brazed connection, or in an area of the refrigerant circuit adjacent to a joint between refrigerant pipes; and a controller configured to determine presence of refrigerant leakage based on a temperature detected by the temperature sensor, the temperature sensor being covered by a heat insulation material together with the brazed connection or the joint, the controller being configured to activate the fan upon determining that refrigerant leakage is present, and deactivate the fan when a rate of change over time of the temperature detected by the temperature sensor is positive.

4. The refrigeration cycle apparatus of claim 3, wherein the controller is configured to activate the deactivated fan again when the rate of change over time of the temperature detected by the temperature sensor is negative.

5. The refrigeration cycle apparatus of claim 3, wherein the controller is configured to deactivate the fan when the rate of change over time of the temperature detected by the temperature sensor remains positive for a time equal to or greater than a preset threshold time.

* * * * *